US012650018B2

(12) United States Patent
Vega-Gutierrez et al.

(10) Patent No.: US 12,650,018 B2
(45) Date of Patent: Jun. 9, 2026

(54) INTEGRATED ROOF SYSTEM WITH ENGINEERED WOOD

(71) Applicant: LOUISIANA-PACIFIC CORPORATION, Nashville, TN (US)

(72) Inventors: Sarath Vega-Gutierrez, Corvallis, OR (US); Jarrod Kevin Line, Brentwood, TN (US); Qining Sun, Franklin, TN (US); Luke Michas, Nashville, TN (US); Felicia Fancher, Nashville, TN (US); Rylie Barling, Kansas City, MO (US); William H. Baird, Nashville, TN (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 352 days.

(21) Appl. No.: 18/129,803

(22) Filed: Mar. 31, 2023

(65) Prior Publication Data

US 2023/0313533 A1 Oct. 5, 2023

Related U.S. Application Data

(63) Continuation-in-part of application No. 17/944,933, filed on Sep. 14, 2022, now abandoned, and a continuation-in-part of application No. 17/858,591, filed on Jul. 6, 2022, now abandoned, and a continuation-in-part of application No. 17/685,048, filed on Mar. 2, 2022, now abandoned, and a continuation-in-part of application No. 17/200,648, filed on Mar. 12, 2021, now abandoned, and a continuation-in-part of application No. 17/068,712, filed on Oct. 12, 2020, now Pat. No. 12,180,714.

(Continued)

(51) Int. Cl.

| | |
|---|---|
| ***E04D 3/35*** | (2006.01) |
| ***E04D 3/361*** | (2006.01) |
| ***E04D 13/17*** | (2006.01) |

(52) U.S. Cl.

CPC ..... *E04D 3/35* (2013.01); *E04D 3/361* (2013.01); *E04D 13/17* (2013.01)

(58) Field of Classification Search

CPC .... E04D 3/35; E04D 3/34; E04D 3/38; B32B 21/02; B32B 2419/06

USPC ..... 52/519, 540, 591.4

See application file for complete search history.

(56) References Cited

U.S. PATENT DOCUMENTS 2,447,272 A * 8/1948 Parkes ..... E04B 1/6104 52/578

3,468,086 A * 9/1969 Warner ..... E04D 3/351 52/173.1

(Continued)

*Primary Examiner* — Brian E Glessner

*Assistant Examiner* — Adam G Barlow

(74) *Attorney, Agent, or Firm* — Wayne Edward Ramage; Baker Donelson

(57) ABSTRACT

A multi-layered integrated roofing plank or panel with a base layer comprising engineered or manufactured wood, a water resistant barrier layer covering at least the outer face of the base layer, and at least one of the edges of the base layer. A texturizing material also may be affixed to, or integrated with, the water resistant barrier layer. The edges of the roofing plank or panel may be configured as part of a joint with adjacent planks or panels, including, but not limited to, shiplap joints, tongue-and-groove joints, bead-and-cove joints, butt joints, or combinations or variations thereof.

20 Claims, 37 Drawing Sheets

Related U.S. Application Data

(60) Provisional application No. 63/326,208, filed on Mar. 31, 2022, provisional application No. 63/243,806, filed on Sep. 14, 2021, provisional application No. 63/218,587, filed on Jul. 6, 2021, provisional application No. 63/155,343, filed on Mar. 2, 2021, provisional application No. 63/001,563, filed on Mar. 30, 2020, provisional application No. 62/988,849, filed on Mar. 12, 2020, provisional application No. 62/962,240, filed on Jan. 17, 2020.

(56) References Cited

U.S. PATENT DOCUMENTS 4,932,184 A * 6/1990 Waller ..... E04D 3/24 52/542
5,251,416 A * 10/1993 White ..... E04D 5/143 52/459
7,442,658 B2 * 10/2008 Rodrigues ..... B32B 27/06 442/180
7,452,598 B2 * 11/2008 Shiao ..... E04D 5/12 428/407
10,711,453 B1 * 7/2020 Jordan ..... E04C 2/246
10,927,542 B2 * 2/2021 St. Germain ..... E04B 1/665
10,982,441 B2 * 4/2021 Chevillard ..... E04C 1/40
11,118,354 B2 * 9/2021 Tang ..... E04D 1/26
2004/0055240 A1 * 3/2004 Kiik ..... B32B 27/06 52/545
2008/0110103 A1 * 5/2008 Fontecchio ..... E04D 7/005 52/24
2008/0134604 A1 * 6/2008 Daniels ..... E04D 13/17 52/302.1
2010/0028690 A1 * 2/2010 Parks ..... C09D 7/61 206/568
2011/0265416 A1 * 11/2011 Southwell ..... E04B 2/707 52/515
2012/0036705 A1 * 2/2012 Gehris ..... B25H 1/02 29/559
2012/0288678 A1 * 11/2012 Grube ..... B32B 11/10 428/150
2016/0168864 A1 * 6/2016 Ramachandra ..... B32B 37/1207 52/588.1
2017/0260748 A1 * 9/2017 Buhrman ..... B32B 5/245
2020/0139663 A1 * 5/2020 Sweet ..... B32B 15/18
2021/0246656 A1 * 8/2021 St. Germain ..... E04F 13/04
2021/0323343 A1 * 10/2021 Braun ..... E04F 15/02033

* cited by examiner

1290

INTEGRATED ROOF SYSTEM WITH ENGINEERED WOOD

This application is a continuation-in-part of U.S. patent application Ser. No. 17/068,712, filed Oct. 12, 2020, which claims benefit of and priority to U.S. Provisional App. No. 62/914,306, filed Oct. 11, 2019, App. No. 62/962,240, filed Jan. 17, 2020, and App. No. 62/988,849, filed Mar. 12, 2020; this application also is a continuation-in-part of U.S. patent application Ser. No. 17/200,648, filed Mar. 12, 2021, which claims benefit of U.S. Provisional App. No. 62/988,849, filed Mar. 12, 2020, and U.S. Provisional App. No. 63/001,563, filed Mar. 30, 2020; this application also is a continuation-in-part of U.S. patent application Ser. No. 17/685,048, filed Mar. 2, 2022, which claims benefit of U.S. Provisional App. No. 63/155,343, filed Mar. 2, 2021; this application also is a continuation-in-part of U.S. patent application Ser. No. 17/858,591, filed Jul. 6, 2022, which claims benefit of U.S. Provisional App. No. 63/218,587, filed Jul. 6, 2021; this application also is a continuation-in-part of U.S. patent application Ser. No. 17/944,933, filed Sep. 14, 2022, which claims benefit of U.S. Provisional App. No. 63/243,806, filed Sep. 14, 2021; this application also claims benefit of and priority to U.S. Provisional App. No. 63/326,208, filed Mar. 31, 2022. All of the above-identified patent applications and provisional applications are incorporated herein in their entireties by specific reference for all purposes.

FIELD OF INVENTION

This invention relates to a multi-layered engineered roofing structural panel (which can be wood-based, such as, but not limited to, oriented-strand board (OSB), plywood, or other lignocellulosic-based panel) with integrated ventilation.

BACKGROUND OF THE INVENTION

Current roof assemblies are typically multiple layers of several materials, each performing a single function, that are installed separately on the site in which the building is being constructed. In many roofing systems, there is a deck, an underlayment barrier on top of the deck, covered by a surface layer of shingles (e.g., asphalt, ceramic, metal, and the like). Compatibility between the various layers creates challenges not only for the designer, but also for the installers. In addition, a varied and large amount of materials are required during the installation, as well as during maintenance (e.g., re-roofing).

A central layer in most such assembles in a wood panel product, or an integral composite engineered panel product, including, but not limited to, engineered wood composite products formed of lignocellulosic strands or wafers (sometimes referred to as oriented-strand board, or OSB). Products such as fiberboard and particleboard have been found to be acceptable alternatives in most cases to natural wood paneling, sheathing and decking lumber. Fiberboard and particleboard are produced from wood particles bonded together by an adhesive, the adhesive being selected according to the intended use of and the properties desired for the lumber. Often times, the adhesive is combined with other additives to impart additional properties to the lumber. Additives can include, but are not limited to, fire retardants, insect repellants, moisture resistant substances, fungicides and fungal resistant substances, and color dyes. A significant advantage of fiberboard and particleboard lumber products is that they have many of the properties of plywood, but can be made from lower grade wood species and waste from other wood product production, and can be formed into lumber in lengths and widths independent of size of the harvested timber.

A major reason for increased presence in the marketplace of the above-described product alternatives to natural solid wood lumber is that these materials exhibit properties like those of the equivalent natural solid wood lumber, especially, the properties of retaining strength, durability, stability and finish under exposure to expected environmental and use conditions. A class of alternative products are multilayer oriented wood strand particleboards, particularly those with a layer-to-layer oriented strand pattern, such as OSB. Oriented, multilayer wood strand boards are composed of several layers of thin wood strands, which are wood particles having a length which is several times greater than their width. These strands are formed by slicing larger wood pieces so that the fiber elements in the strands are substantially parallel to the strand length. The strands in each layer are positioned relative to each other with their length in substantial parallel orientation and extending in a direction approaching a line which is parallel to one edge of the layer. The layers are positioned relative to each other with the oriented strands of adjacent layers perpendicular, forming a layer-to-layer cross-oriented strand pattern. Oriented, multilayer wood strand boards of the above-described type, and examples of processes for pressing and production thereof, are described in detail in U.S. Pat. Nos. 3,164,511, 4,364,984, 5,435,976, 5,470,631, 5,525,394, 5,718,786, and 6,461,743, all of which are incorporated herein in their entireties by specific reference for all purposes.

Roof ventilation is an important part of the building process and service life of a house. A roof without good airflow can result in mold and other wood decay organisms growing under it, due to the increased temperature and moisture content of the environment in the area under the roof, which generates optimal growth conditions for the aforementioned organisms. In contrast, however, a roof with excessive ventilation can cause energy loss by not providing effective temperature regulation (i.e., by letting too much cold and/or hot air escape from the house), thus requiring HVAC and/or AC systems to operate more frequently and increase their energy consumption.

Present methods to ventilate the roof include leaving a gap between the roof sheathing and the edge of the ridge. This gap is then covered with a felt fabric and a ridge cap (some products have the felt integrated with the ridge cap). The ridge cap might have channels to promote air movement. Another method comprises the installers cutting rectangle shaped sections (i.e., exhaust vents) at the ridge of the roof, then covering them with felt and a ridge cap. This latter method relies on the accuracy and experience of the roofer, as the size of the cut off will affect the roof ventilation.

SUMMARY OF INVENTION

In various exemplary embodiments, the present invention comprises a multi-layer panel for use as integrated structural sheathing on a roof. In one embodiment, the multi-layer panel comprises a wood structural core or panel, such as OSB or plywood. The panel may be coated or treated, during or after the manufacturing process, with a product that provides various properties, such as, but not limited to, weather resistance, fungus resistance, insect resistance, and/or fire resistance. The treatment may be integrated with the material forming the wood structural panel, or may be a coating on one or both surfaces. A weather or water resistive barrier (WRB), or the paper base for a WRB, of some kind is applied to the upper or outward facing surface of the panel, effectively serving as an underlayment. The outer surface of the WRB or paper base is then coated with a polymer, adhesive, and/or asphalt. In turn, it is coated with a granular or solid material (such as, but not limited to, ceramic coated granules, clay, rock, glass, slate, rubber or combinations thereof). In one embodiment, the polymer on the paper overlay base serves as the WRB as well as adhesive for the granular material.

In several embodiments, the overlap and underlap of adjacent integrated roofing panels are matched to form an overlapping or shiplap joint, with integrated flashing extending from the overlap end (and over the shiplap joint between the upper and lower adjacent panels when placed on the roofing structure). Flashing is one of the main steps for roofing, where a thin material, such as galvanized steel, is used to protect the sheathing and the outer trusses of the house structure by directing water away from those areas. This step presents a challenge when dealing with an integrated roof panel or plank, as in prior art applications the flashing typically is placed under the water resistance barrier and the asphalt shingles. This invention overcomes that problem by merging the flashing into the integrated roofing panels, thereby reducing installation time.

In several embodiments, the flashing comprises a polymer (which may be rigid, semi-rigid, and/or flexible) extending outward on one, two, or more sides of the integrated roofing panel. A piece of flashing may have a constant rigidity or flexibility throughout, or the rigidity or flexibility may be variable. In some embodiments, the flashing may have the same or similar color and/or texture as the upper or outward facing surface of the roofing panel, although in some embodiment a different or contrasting color and/or texture may be used.

The present invention applies the flashing, WRB and/or texturizing aggregate to the panel at the manufacturing facility, prior to shipping or installation at a job site (and thereby avoiding the problems noted above). In one embodiment, a fluid or liquid applied membrane is applied via one or more spray nozzles in a manufactured line process. The spray nozzle or nozzles are in fluid communication with one or more storage tanks, and the liquid may be stored without the use of agitators. As the panel travels down a secondary production line, the WRB coating is sprayed on the top face, and in some embodiments, also the edges, of the panel at a minimum thickness of 5-10 mils. If the coating is not sprayed on the edges, the edges are sealed by other means. The asphalt/adhesive and surface layer may be applied in a similar manner, or as part of the WRB application. In other embodiments, the WRB may be a solid layer (e.g., paper overlay) that is applied during the panel manufacturing process.

In several additional embodiments, end pieces of the present system (i.e., the integrated panels that are installed at or adjacent to the roof of the ridge) comprise vents or other ventilation means installed or integrated with the panel at the factory (i.e., during the manufacturing process). The vents are formed by rectangular sections of longitudinal cuts made along the panel or plank. The cuts may be similar to a vented soffit, but the surface of the cut area is coated with a water-resistant finish. The vents may be located along the upper part of the plank (i.e., proximate the ridge of the roof), which permits coverage by felt fabric and ridge cap.

In additional embodiments, the lower (or "downhill") edge of certain integrated roofing panels, such as those that are "starting planks" comprises an integrated drip edge or "driplap edge" that promotes water evacuation from the roof surface while keeping it away from the walls below the roof edge.

DETAILED DESCRIPTION OF EXEMPLARY EMBODIMENTS

Figure 1:
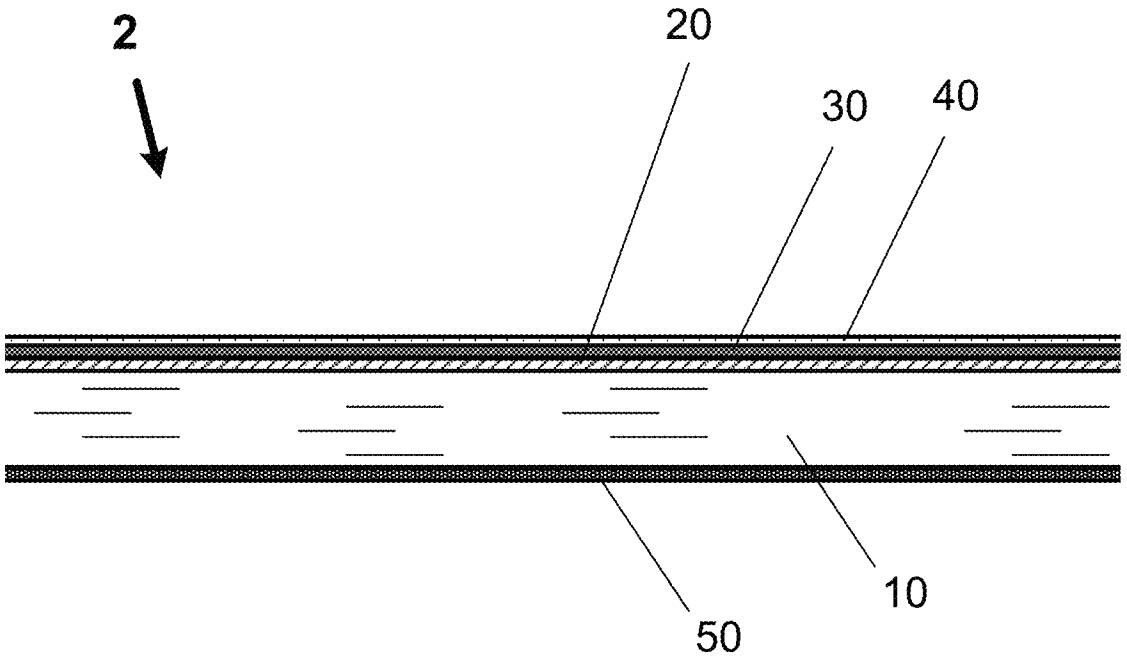
FIG. 1 shows a sectional view of a roofing panel or plank in accordance with an embodiment of the present invention.
Figure 2:
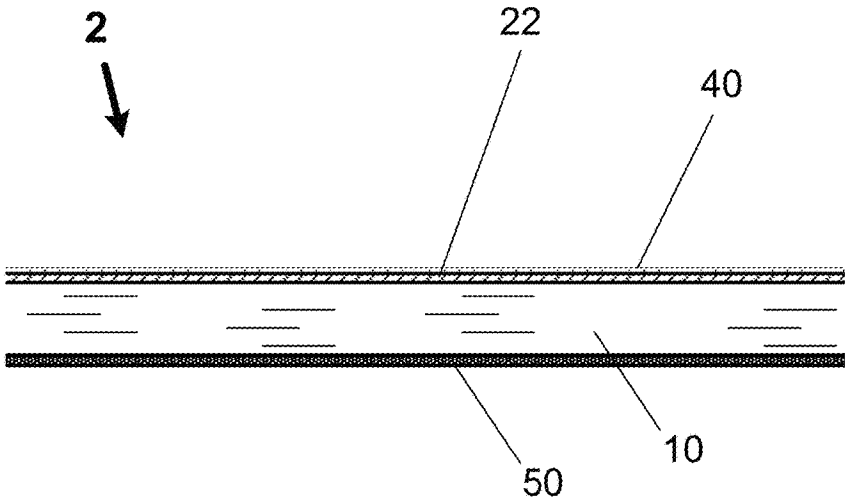
FIG. 2 shows a sectional view of an alternative embodiment of a roofing panel or plank in accordance with another embodiment of the present invention.

In various exemplary embodiments, as seen in FIGS. 1-2, the present invention comprises an improvement to a multi-layer panel or plank 2 for use as integrated structural sheathing on a roof. In the embodiment shown, the multi-layer integrated roofing product comprises a wood structural panel or plank 10. The wood may be natural or manufactured, engineered wood, such as oriented strand board (OSB) or plywood. The panel may be coated or treated, during or after the manufacturing process, with a product that provides various properties, such as, but not limited to, weather resistance, fungus resistance, insect resistance, and/or fire resistance. The treatment may be integrated with the material forming the wood structural panel, or may be a coating on one or both surfaces. Examples of integrated roofing panels are disclosed in U.S. patent application Ser. No. 17/068,712, filed Oct. 12, 2020 by Louisiana-Pacific Corp, and U.S. patent application Ser. No. 17/200,648, filed Mar. 12, 2021, both of which are incorporated herein in their entireties by specific reference for all purposes.

In the embodiment shown, a weather or water resistive barrier (WRB) 20 of some kind is applied to the upper or outward facing surface of the panel 10, effectively serving as an underlayment. The WRB may be a form of paper overlay, a form of spray-applied or fluid-applied polymer or material (such as silicone), or other form of WRB. In some embodiments, the WRB may include a granular or solid material 40 as a texturizing aggregate or material (such as, but not limited to, ceramic coated granules, clay, rock, glass, slate, styrene, particles of polymeric plastic, or combinations thereof) as a component or part of the WRB itself (e.g., texturizing aggregate or material may be mixed with a liquid polymer WRB). Alternatively, the granular or solid material 40 may be subsequently applied directly to the WRB after the WRB is applied to the plank/panel. In yet a further embodiment, the outer surface of the WRB may be coated with a polymer, adhesive and/or asphalt 30, which is turn is coated with the granular or solid material 40. In some embodiments, the adhesive and/or asphalt may include the granular or solid material as a component or part (e.g., texturizing aggregate or material may be mixed with the adhesive and/or asphalt). In alternative embodiments, an outer polymeric layer also may act as an aesthetics or appearance layer, in which case addition granular or solid material may or may not be present.

The invention thus effectively combines a structural sheathing panel, WRB layer or polymer, and texturizing aggregates or materials, if present (e.g., surface layer, shingles, metals, or other roof surface materials), as separately applied in the prior art, into one multi-layer panel product, which is less reliant on skilled labor for installation at a job site and reduces installation time by eliminating the separate sequential application of a WRB system and a surface layer in the installation process. As discussed above, in some embodiments, the WRB may be a separate layer, or it may be integrated with the texturizing aggregate/surface layer.

In several embodiments, the texturizing aggregate or top surface layer may be one or more flexible rolls of material, which may be applied by unrolling the material across the panel during manufacture (or, in some embodiments, at the job site). The roll may have a self-adhesive layer on one side. In one embodiment, the surface layer rolls may comprise one or more rolls of one-sided or two-sided construction tape (i.e., with strong, permanent adhesive on one or two sides). One side of the tape adheres to the panel, while the other side contains the surface material. The tape may be applied to the panel at the factory, or otherwise prior to installation at the job site.

Figure 3:
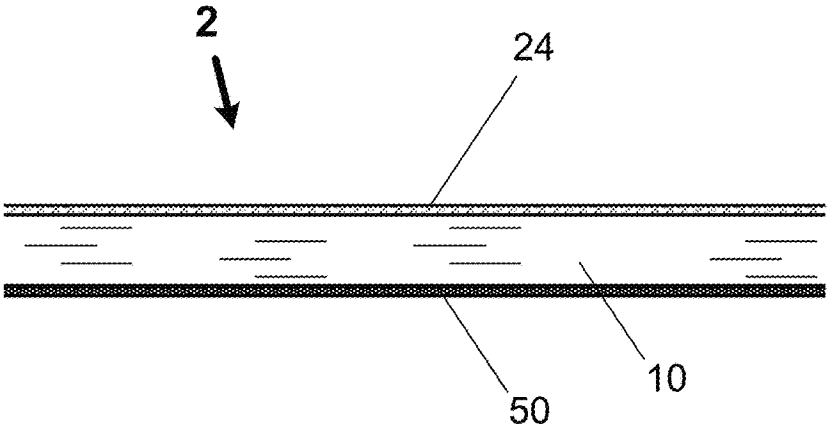
FIG. 3 shows a sectional view of an alternative embodiment of a roofing panel or plank in accordance with another embodiment of the present invention.
Figure 4:
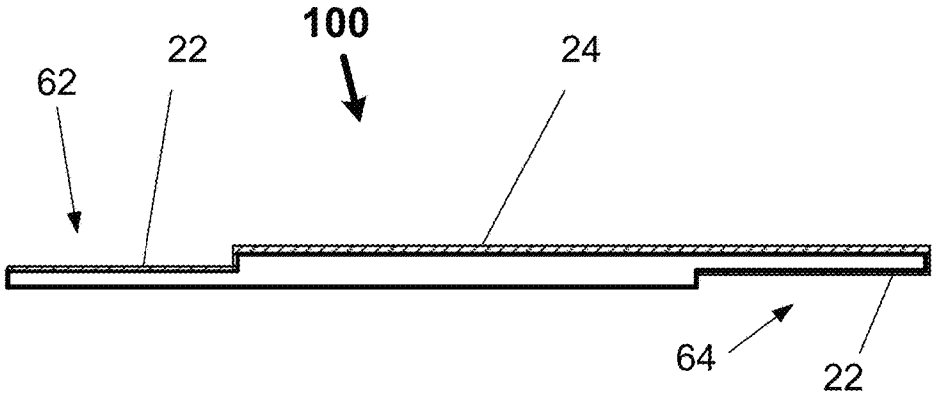
FIG. 4 shows a sectional view of an alternative embodiment of a roofing panel or plank with overlap and underlap joint sections in accordance with another embodiment of the present invention.
Figure 5:
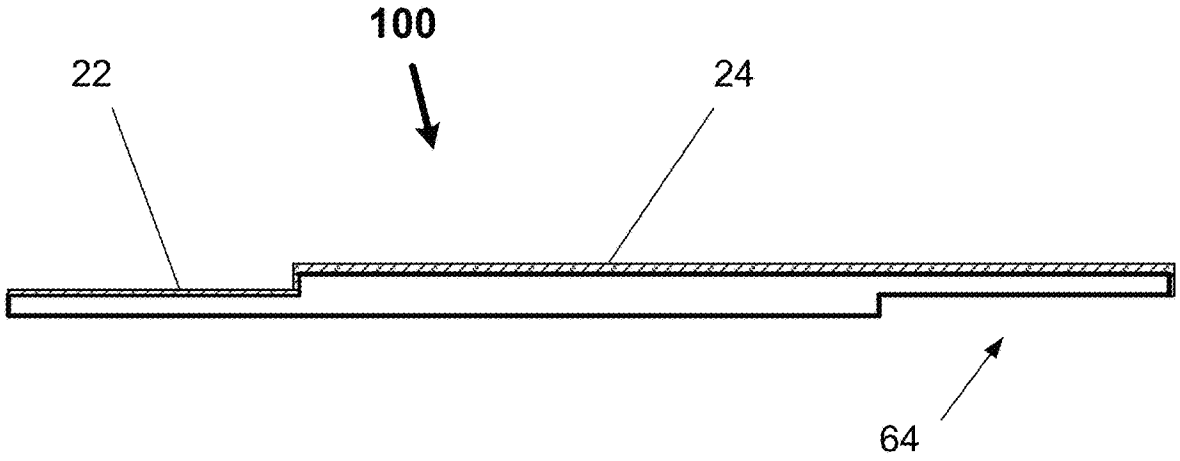
FIG. 5 shows an alternative embodiment of the roofing panel or plank of FIG. 4.

FIGS. 3-4 show an example of a standard integrated roofing panel or plank 100 with a WRB polymer layer as described above 100, with an "uphill" underlap 110 and a "downhill" overlap 120, wherein the overlap and underlap of vertically adjacent integrated roofing panels are matched to form an overlapping or shiplap joint. (Uphill and downhill are described with respect to an angled roof, with uphill being the direction towards the peak or crown of the roof, and downhill being the direction away from the peak or crown of the roof, so that water runs "downhill" and off the roof.) The standard integrated roofing panel or plank is used for the main courses (rows) of roofing planks/panels applied to a roof, with shiplap joints formed between vertically adjacent planks/panels in the courses. The right and left ends of planks/panels may be aligned with the corresponding ends of planks/panels in the vertically adjacent courses, or may be staggered or alternating. Other forms of joints may be used, such as, but not limited to, tongue-and-groove joints, bead-and-cove joints, butt joints, or combinations or variations thereof.

Some or all of the respective faces of the shiplap joint may be covered with the WRB polymer layer 22. FIGS. 4-8 shows various embodiment of a roofing plank/panel with the WRB polymer protective layer 22 (typically without texturizing granules, as contrasted to the WRB polymer protective layer with texturizing granules or other materials 24 on the outer face) extending around and over the edges, and some or all of parts of the corresponding shiplap joint sections, thereby providing greater protection to the manufactured wood (e.g., OSB) core layer 10. In some embodiments, the WRB polymer protective layer on the edges and/or shiplap joint sections may include texturizing granules or other materials.

An integrated sealant or adhesive material, such as the WRB polymer 22 or other form of sealant or adhesive, is applied to one face (or both faces) of corresponding overlap and/or underlap sections. Where the WRB polymer is used as a sealant, the two surfaces coated with the polymer are placed in contact with each other. Nails or similar fasteners used to affix the planks/panels to the roofing structure may be used in the joint area to keep the surfaces in contact (and apply a level of pressure thereto) to cause the polymer-covered surfaces to self-seal.

Figure 9:
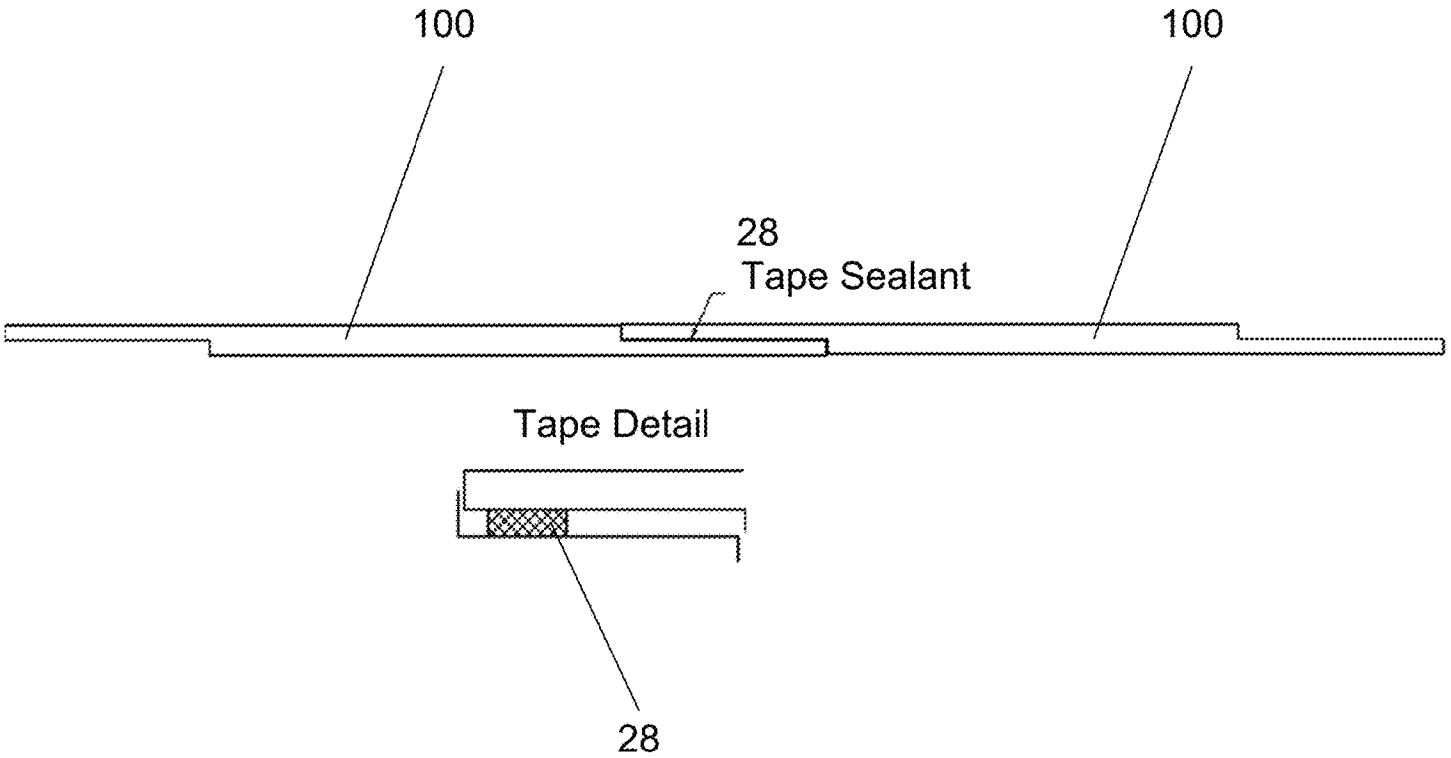
FIG. 9 shows a section view and detail of a completed shiplap joint formed with pre-applied double-sided tape between vertically adjacent roofing panels or planks.

In an additional embodiment, as seen in FIG. 9, the sealant comprises industrial double-sided tape 28, and extends across the width of the plank/panel (i.e., the full length of the lap section). The tape 28 is pre-applied in the factory or manufacturing facility, with the opposite side remaining covered with a liner. During installation, the installer removes the liner to form the joint between adjacent planks/panels. The double-sided tape also may be used for butt joints (or square end joints) between planks/panels.

Figure 6:
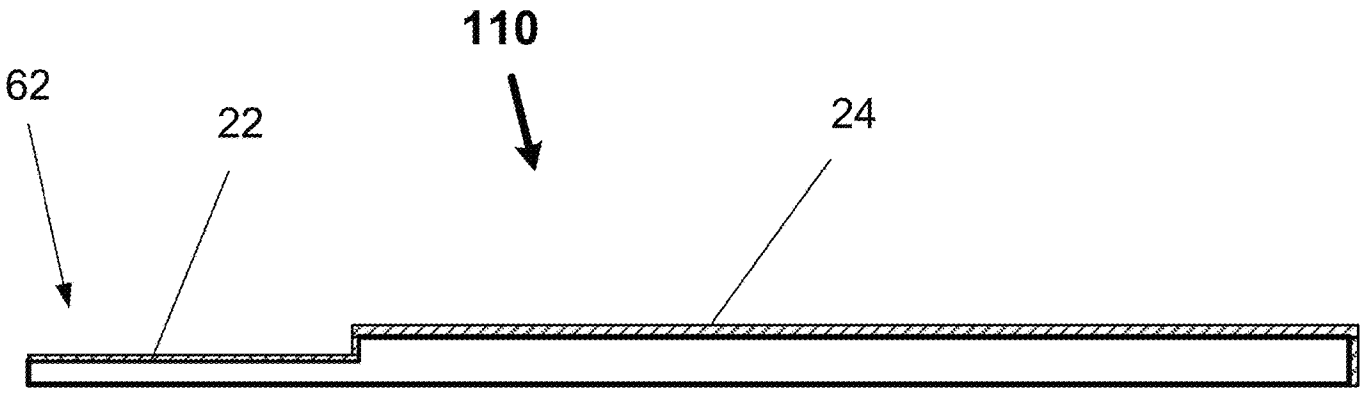
FIG. 6 shows a section view of a "starter" roofing panel or plank.
Figure 7:
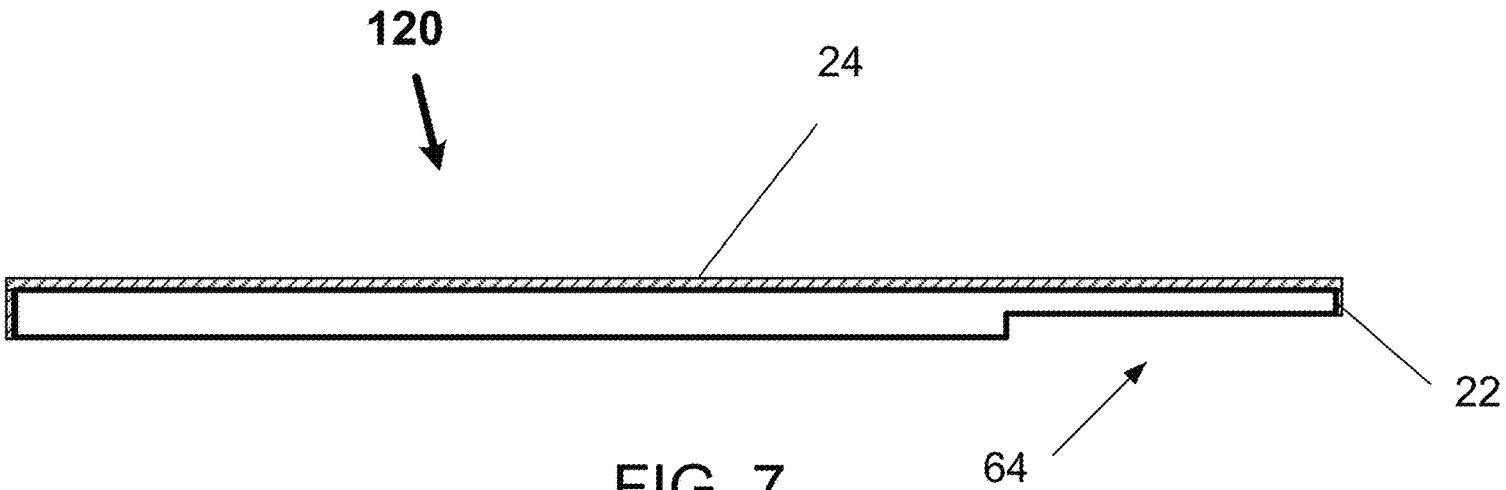
FIG. 7 shows a section view of a "crown" roofing panel or plank.
Figure 8:
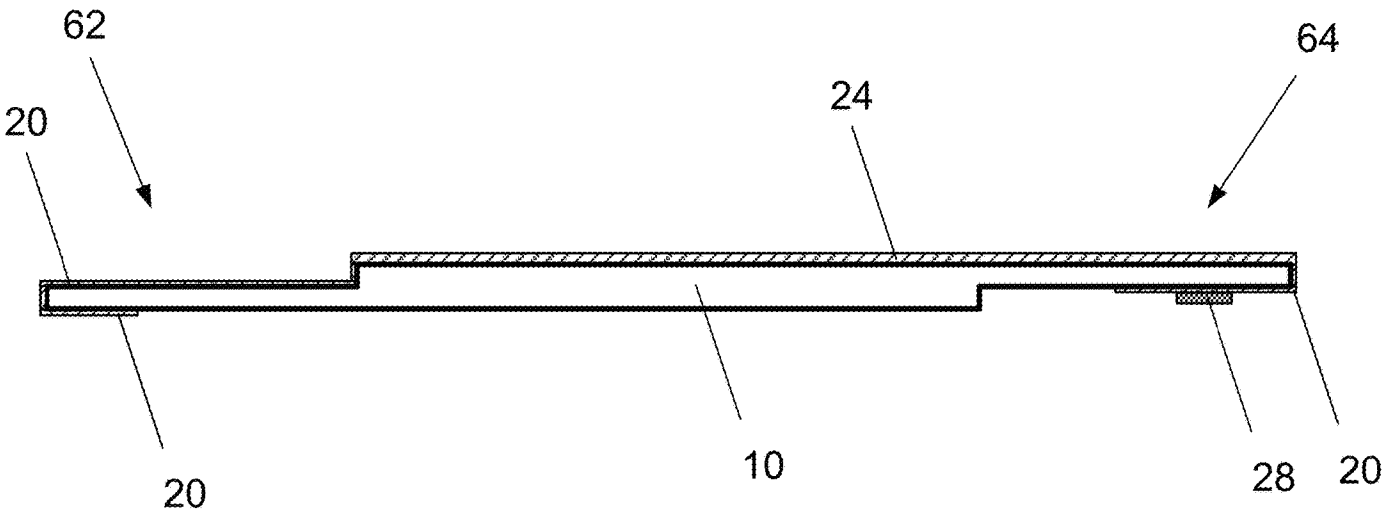
FIG. 8 shows a sectional view of an alternative embodiment of a roofing panel or plank with overlap and underlap joint sections with pre-applied double-sided tape or adhesive in accordance with another embodiment of the present invention.
Figure 19:
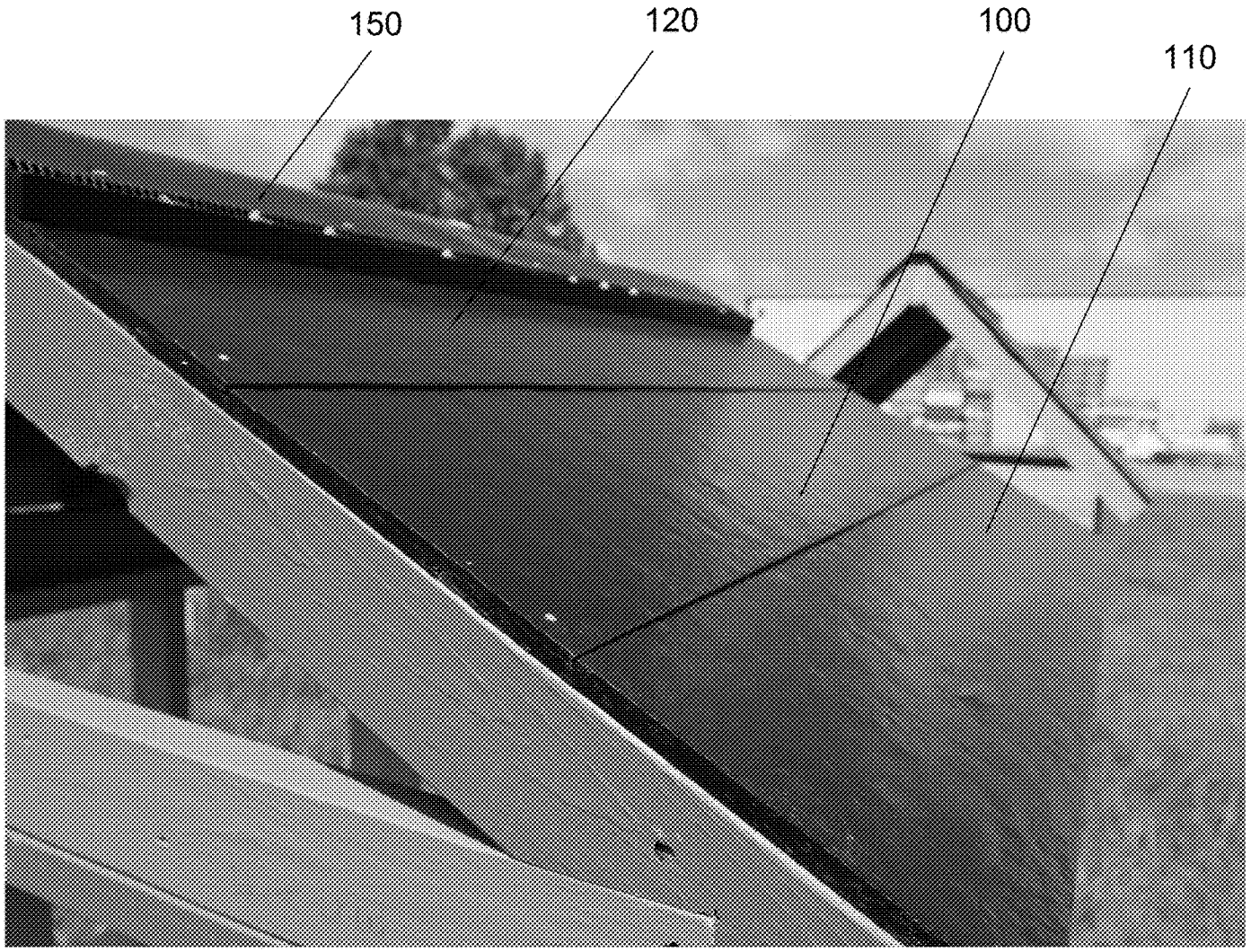
FIG. 19 shows a side view of an exemplary three-course roofing installation with shiplap joints, with a crown row, a standard row, and a starter row.

"Starter" roofing pieces 110 are shown in FIGS. 6 and 19. These pieces are located along the bottom edge of the roofing, and comprise a square, butt or plain end on the "downhill" or bottom edge, or a "driplap" edge 6 as described below, while retaining the underlap 62, 110 on the "uphill" edge to form a shiplap joint with the next adjacent course. In a similar fashion, top or crown pieces 120 are shown in FIGS. 8 and 19. These pieces are located along the top edge of the roofing along the crown of the roof (which may then be covered by a roof ridge cap 150 as known in the prior art). These pieces comprise a square, butt or plain end on the "uphill" or top edge, while retaining the overlap 64 on the "downhill" edge to form a shiplap joint with the next adjacent course.

During installation, a course or row of "starter" roofing pieces 110 is affixed along the bottom edge of the roofing, with the underlap section on the top edge. A course of standard roofing pieces 100 is then applied, with the overlap section on the bottom edge overlaying the underlap section of the lower course to form a shiplap joint that is airtight and watertight. A number of standard roofing piece courses are then added in sequence up the roof to near the top, with the number determined by the size (height) of the roof. A course or row of "crown" roofing pieces 120 is then added as the final topmost course, with the overlap section on the bottom edge overlaying the underlap section of the lower course, as described above.

In several embodiments, the lower or bottom edge ("downhill" edge) of certain integrated roofing panels, including "starter" roofing pieces ("starting planks") comprises an integrated "driplap edge" 6 that promotes water evacuation from the roof surface while keeping it away from the walls below the roof edge. Prior art drip edges for roofing installations typically are made of aluminum and installed over the sheathing and covered with shingles or metal roofing. This is not possible with the integrated roofing panels as described herein, due the integration of the surface layer in the panel during the manufacturing process. Accordingly, an angle 6*a* is machined or milled along the horizontal bottom edge of the starting plank 110 (i.e., the piece used at the beginning of the roof assembly). This process may be performed at a factory as part of the manufacturing process. In several embodiments, the angle 6*a* between the face of the edge and the upper surface 110*a* of the starting plank 110 is acute. In some embodiments, the angle is 25 degrees or approximately 25 degrees. In alternative embodiments, the angle is approximately 25 degrees, +/−2 degrees, or approximately 23 to 27 degrees. This angle allows for water to be evacuated from the roof away from the house at any roof pitch (as well as reducing installation steps, as the installation of separate drip edges at the job site is eliminated, thereby allowing a reduction in time and cost of installation). This machined angle allows for water evacuation from the roof surface while keeping it away from the walls. It also does not allow water to migrate under the roof, thereby effectively avoiding any potential leak/water damage to the adjacent structural elements in contact with the starting plank The right and/or left ends of the plank/panel may be sealed with the WRB or a sealant. As discussed above, one form of sealant may be double-sided tape 28. Alternatively, an "end cap" may be applied to cover the ends.

Figure 10:
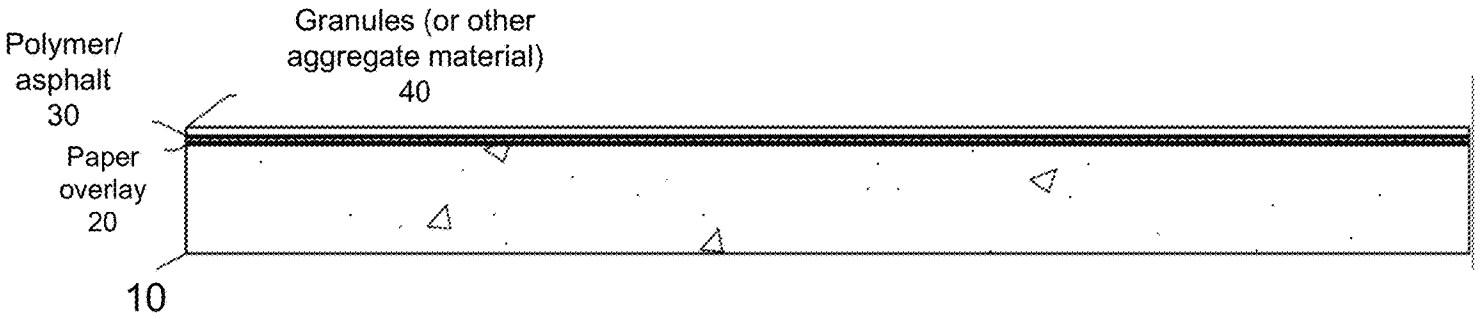
FIG. 10 shows a sectional view of an alternative embodiment of a roofing panel or plank with paper overlay in accordance with another embodiment of the present invention.

FIG. 10 shows an alternative embodiment of a roofing panel with the protective layer with asphalt granules (i.e., polymer and granules) extending around and over the edges, thereby providing greater protection to the manufactured wood (e.g., OSB) core layer. An integrated sealant or adhesive material is applied to one face (or both faces) of corresponding overlap (and/or underlap) sections. In one embodiment, the sealant comprises industrial double-sided tape, and extends across the width of the panel (i.e., the full length of the lap section). The tape is pre-applied in the factory or manufacturing facility, with the opposite side remaining covered with a liner. During installation, the installer removes the liner to form the joint between adjacent panels. The double-sided tape also may be used for butt joins between panels.

Figure 11:
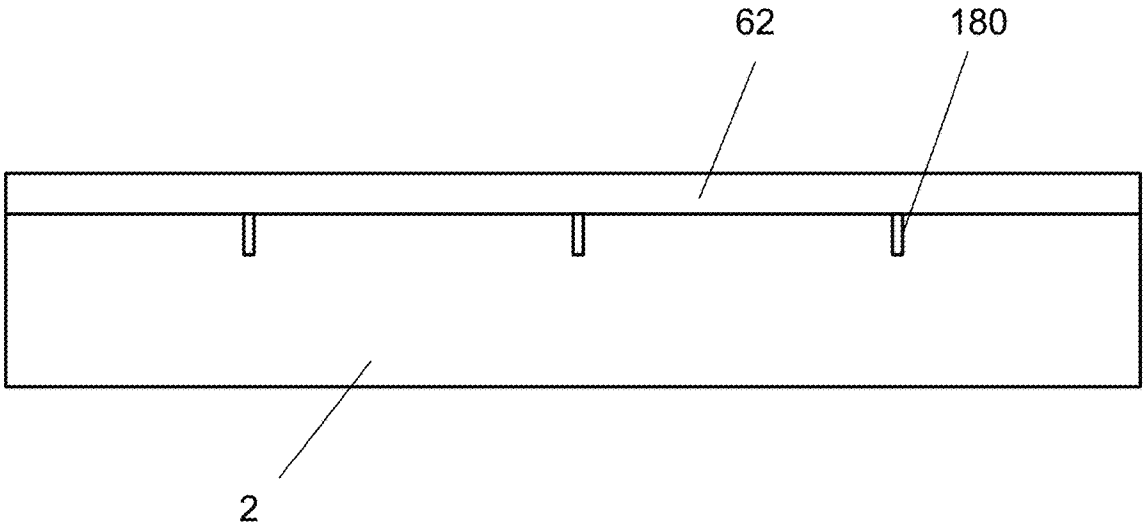
FIG. 11 shows a top view of a roofing plank or panel with drainage channels.
Figure 12:
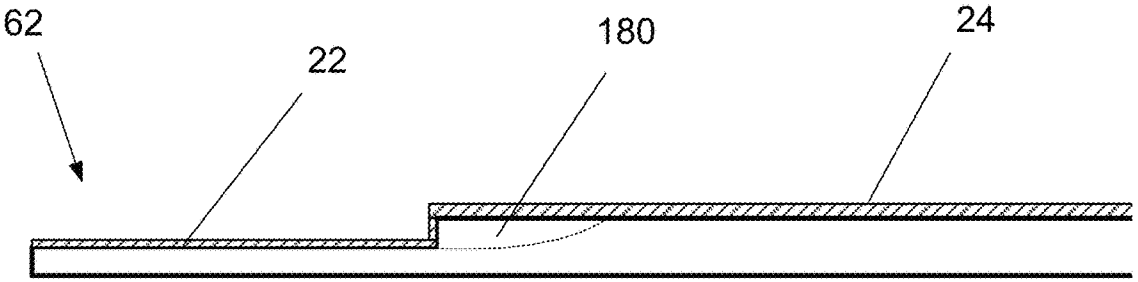
FIG. 12 shows a side section view of a roofing plank or panel with drainage channels.

In several embodiments, as seen in FIGS. 11-12, one or more water evacuation channels or grooves 180 may extend from the shiplap lip proximate the upper edge of each plank/panel at least partway down the outer face. The interior of each channel is coated in a similar manner to the outer face. This allows water that may collect in the horizontal grooves formed by a horizontal shiplap installation to flow down and out of the horizontal grooves onto the outer face (i.e., onto the rooftop). In several embodiments, each channel has a variable depth, with the greatest depth at the shiplap lip (and equal to or approximately equal to the depth (i.e., height) of the lip, with the bottom of the channel then rising to the level of the outer face. The bottom may rise smoothly and gradually, to help promote the flow the water down the channel and out onto the face. The width of the channel should be sufficient to allow water flow down and out, and avoid a capillary effect, but not be so large as to substantially affect the structural integrity of the plank/panel.

The present invention applies the WRB and texturizing aggregate (either integrated or as separate layers) to the plank/panel at a manufacturing facility, prior to shipping or installation at a job site (and thereby avoiding the problems noted above with regard to prior art installations). In one embodiment, a fluid or liquid applied membrane is applied via one or more spray nozzles in a manufactured line process. The spray nozzle or nozzles are in fluid communication with one or more storage tanks, and the membrane liquid may be stored without the use of agitators. Nozzles apply the membrane coating at a constant pressure until reaching the desired wet film thickness. As the plank/panel travels down a secondary production line (typically on a form of conveyor belt), the WRB coating is sprayed on the top face, and in some embodiments, also the edges, of the plank/panel at a minimum thickness of 5-10 mils. If the coating is not sprayed on the edges, the edges are sealed by other means. The asphalt/adhesive and/or surface layers, if separate from each other and from the WRB layer, may be applied in a similar manner. In other embodiments, the WRB may be a solid layer (e.g., paper overlay), as seen in FIG. 6, that is applied during the panel manufacturing process.

Figure 20:
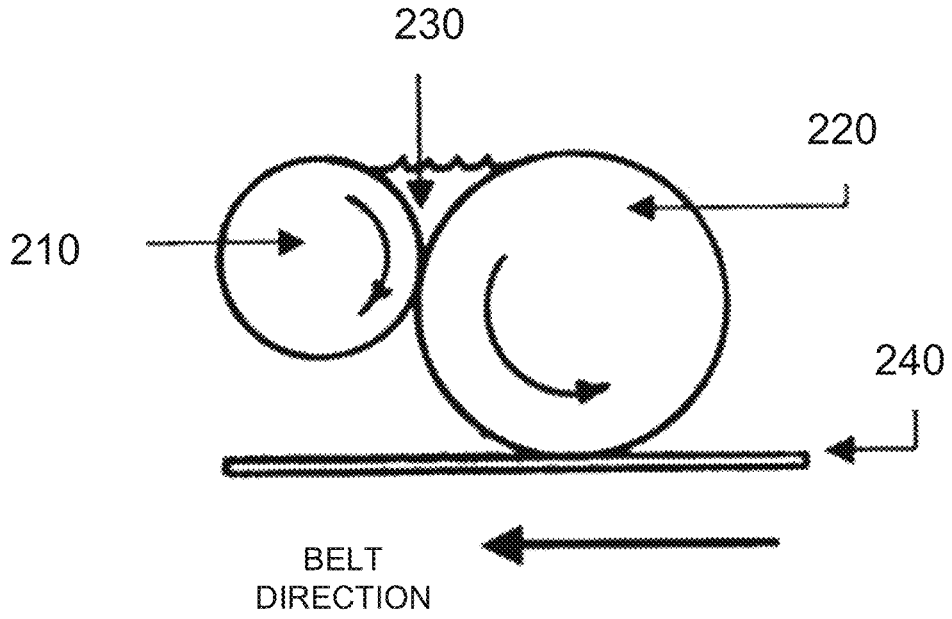
FIG. 20 shows a schematic of a roll coating method to produce the present invention.

In some embodiments, the present invention is produced through a curtain coating method. A storage tank containing the membrane liquid is positioned above the secondary production line. The tank has a longitudinal aperture that allows the membrane liquid to flow from the tank onto the plank/panel as it passes beneath the tank. The width of the aperture is adjusted so the amount of liquid flowing onto the plank/panel is the correct amount to achieve the desired wet film thickness of the coating. In other embodiments, the present invention is produced through a roll coating method. As seen in FIG. 20, two or more rolls (e.g., a doctor roll 210 and a coating roller 220) are positioned above the secondary production line. The membrane liquid (e.g., the polymer coating) is located between the rolls, and passes between the rolls and is applied to the surface of the plank/panel 240 traveling on the line by the coating roller 220. The position of the doctor roll relative to the coating roller is adjusted to let pass the correct amount of liquid pass to achieve the desired wet film thickness of the coating.

In several embodiments, the texturizing surface and/or shingle layer may be one or more flexible rolls of material, and applied by unrolling the material across the plank/panel. The roll may have a self-adhesive layer on one side. In one embodiment, the shingle layer rolls may comprise one or more rolls of one-sided or two-sided construction tape (i.e., with strong, permanent adhesive on one or two sides). One side of the tape adheres to the panel, while the other side contains the shingle material. The tape may be applied to the panel at the factory, or otherwise prior to installation at the job site.

Figure 13:
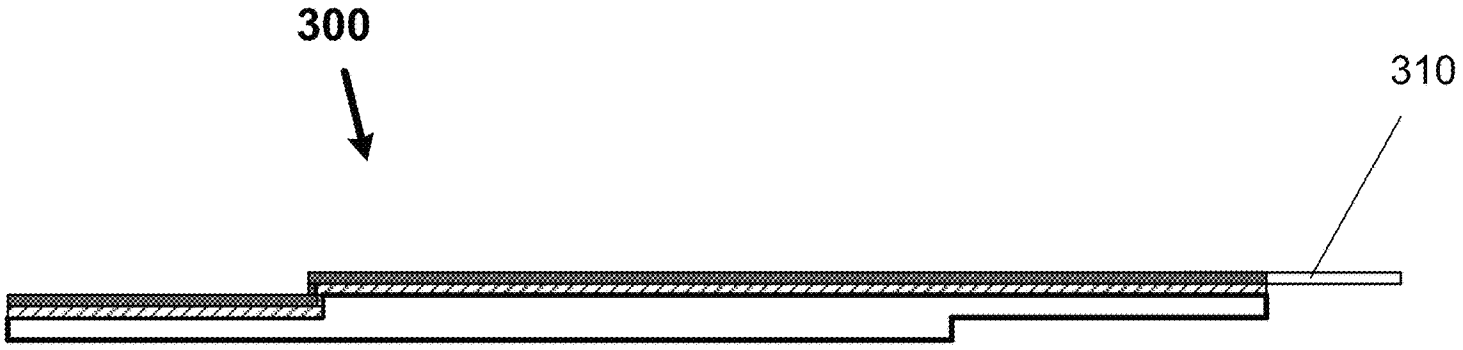
FIGS. 13-16 show views of integrated flashing with a roofing panel.

FIG. 13 shows an example of an integrated roofing panel or plank (with WRB and shingle or granulated layers as described above) 300, with an "uphill" underlap and a "downhill" overlap, wherein the overlap and underlap of adjacent integrated roofing panels are matched to form an overlapping or shiplap joint, with integrated flashing 310 extending from the overlap end (and over the shiplap joint between the upper and lower adjacent panels when placed on the roofing structure). Flashing is one of the main steps for roofing, where a thin material, such as galvanized steel, is used to protect the sheathing and the outer trusses of the house structure by directing water away from those areas. This step presents a challenge when dealing with an integrated roof panel or plank, as in prior art applications the flashing typically is placed under the water resistance barrier and the asphalt shingles. This invention overcomes that problem by merging the flashing 310 into the integrated roofing panels, thereby reducing installation time.

Figure 14:
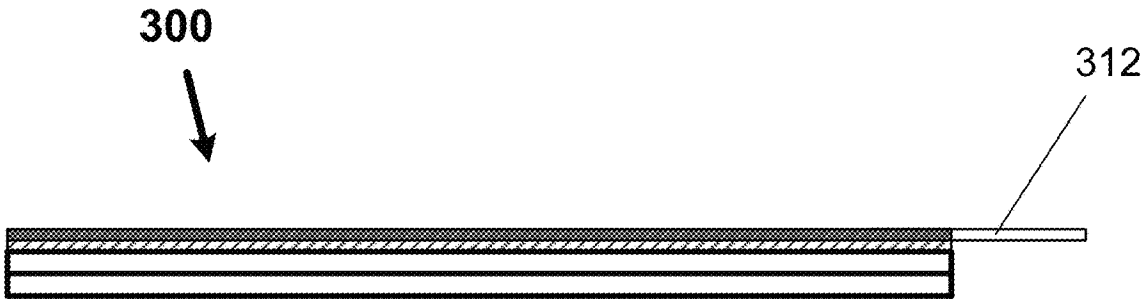
Figure 15:
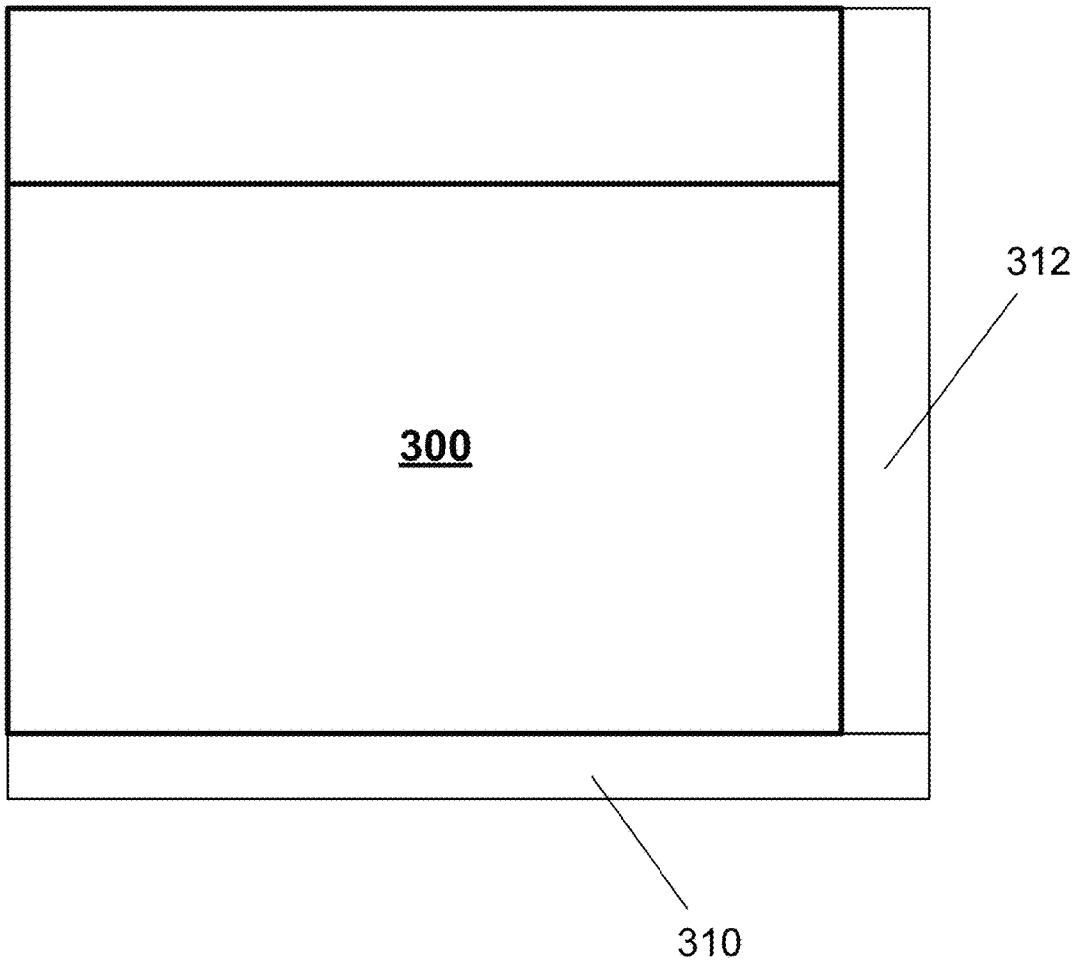

In the embodiments seen in FIGS. 13-15, the flashing 310, 312 comprises a polymer (which may be rigid, semi-rigid, and/or flexible) extending outward on one, two, or more sides of the integrated roofing panel. A piece of flashing may have a constant rigidity or flexibility throughout, or the rigidity or flexibility may be variable. In some embodiments, the flashing may have the same or similar color and/or texture as the upper or outward facing surface of the roofing panel, although in some embodiment a different or contrasting color and/or texture may be used. FIG. 13 shows a cross-section side view of a standard roofing panel, with flashing 310 extending "downhill" from the overlap edge to cover and protect the shiplap joint between adjacent panels. FIG. 14 shows a cross-section bottom view, with flashing 312 extending from the right edge of the standard roofing panel to cover the straight joint between adjacent panel edges on their respective right and left sides. FIG. 15 shows a top view of the panel of FIGS. 13 and 14 (with flashing extending from two sides or edges, the bottom and the right).

Figure 16:
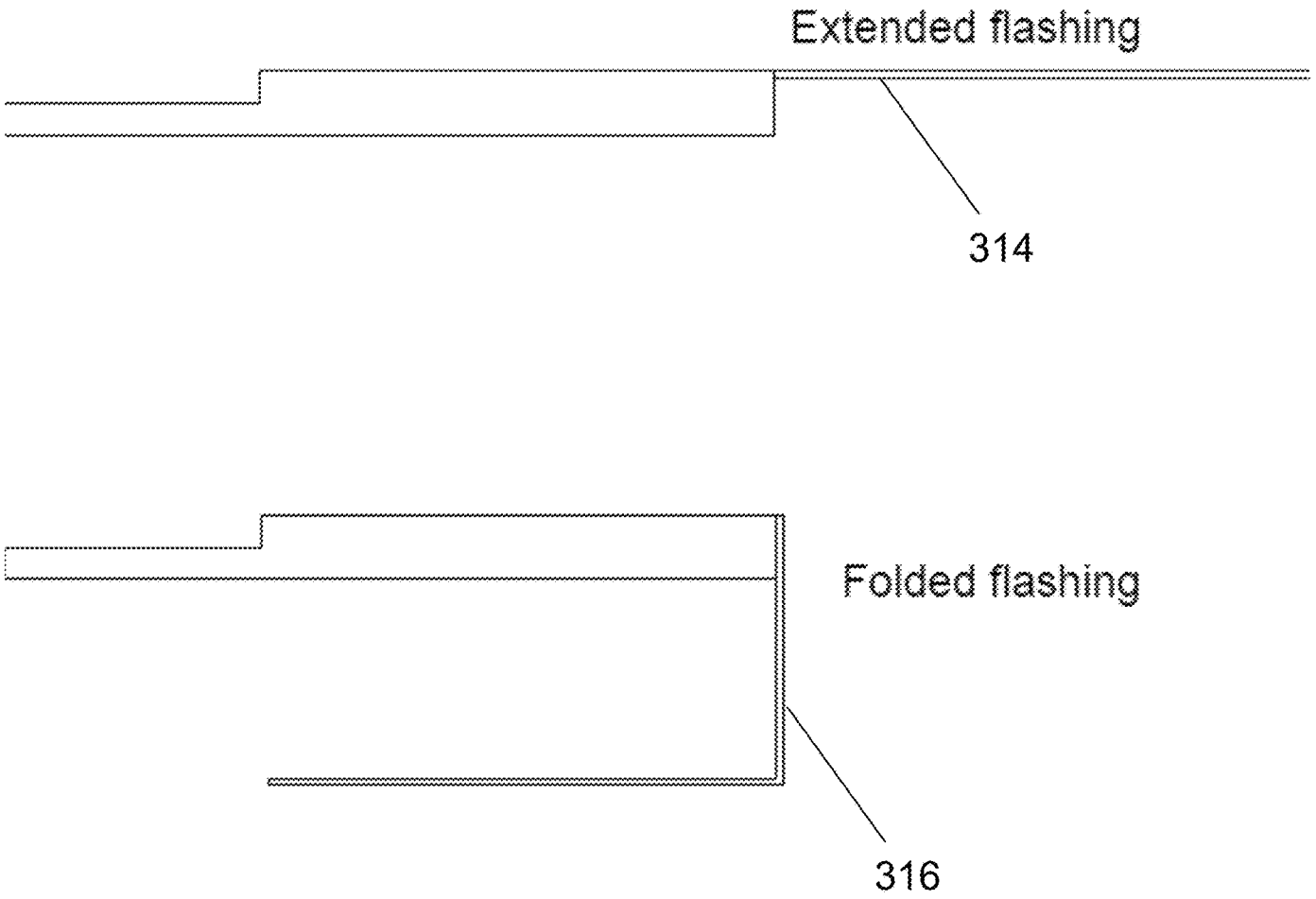
Figure 17:
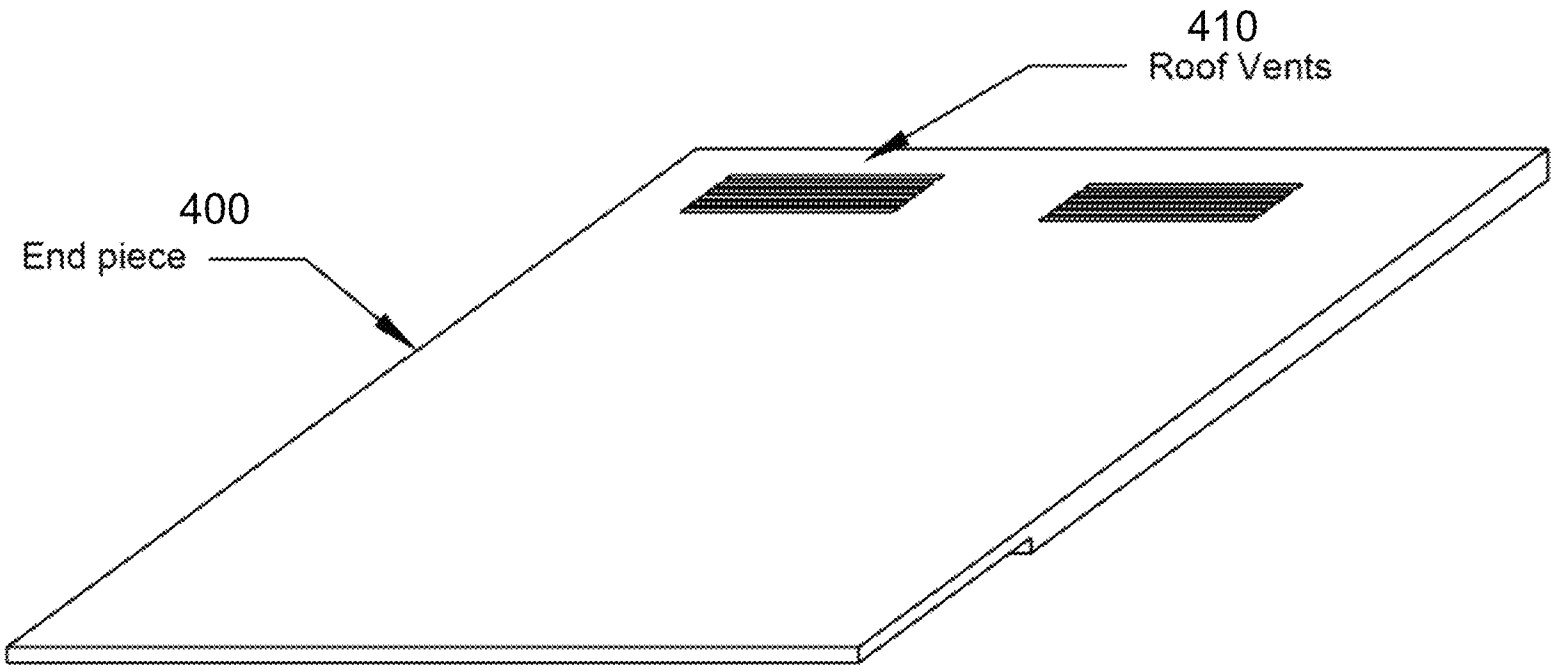
FIG. 17 shows a perspective view of an integrated roofing panel with factory-installed ventilation.
Figure 18:
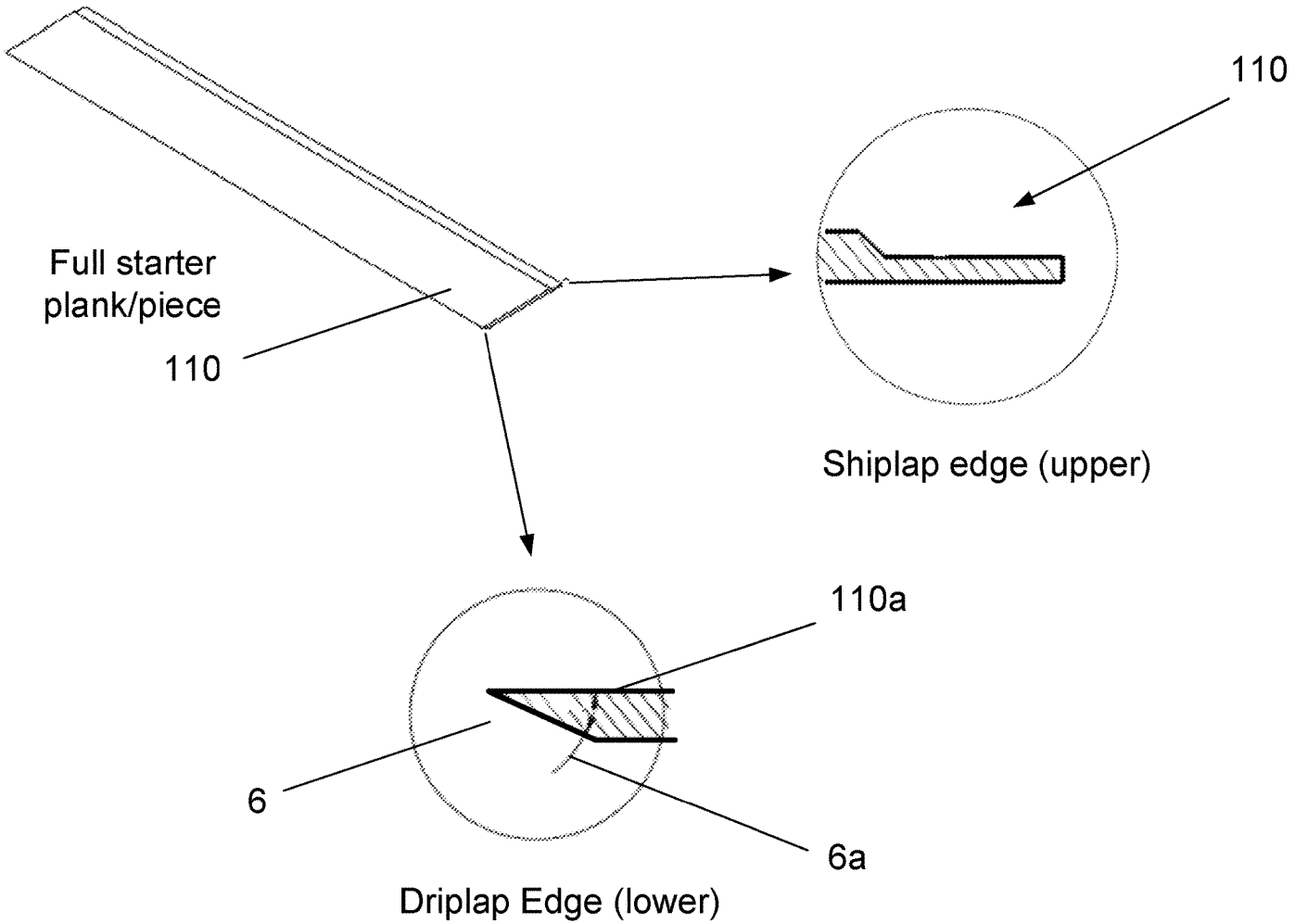
FIG. 18 shows an example of an integrated roofing panel with integrated drip edge.

"Starter" pieces with flashing 314, 316 are shown in FIG. 16. These pieces are located along the bottom edge of the roofing, and comprise a square, plain, or angled end on the "downhill" or bottom edge, while retaining the underlap on the "uphill" edge to form a shiplap joint with the next adjacent course. The flashing on the bottom edge can extend straight 314 (as with the overlap on the standard panel as described above) in a plane parallel to the outer face of the panel, or may be in a "folded" 86 or bent configuration so as to attach around a roofing beam or stud, thereby sealing off and protecting the bottom of the roof. The flashing may be folded at one or more points. Similarly, extended or folding flashing can be added to the upper edges of pieces along the crown of the roof. In additional embodiments, the flashing may comprise a flexible polymer that can be molded during installation to the structure that will be flashed.

In a further embodiment, a radiant barrier layer 50 may be applied to the underside of the panel. Radiant barrier sheathing, typically used for roof and attic sheathing, has become a de facto standard in high solar radiation environments. Radiant barriers are installed in homes and structures, usually in attics, primarily to reduce summer heat gain and reduce cooling costs. The barriers consist of a highly reflective material that reflects radiant heat rather than absorbing it. Radiant heat travels in a straight line away from any surface and heats anything solid that absorbs its energy. Most common insulation materials address conductive and convective heat flow, not radiant heat flow. In contrast, a radiant barrier reduces the radiant heat transfer from the underside of the heated roofing materials to other surfaces in the attic, thereby reducing the cooling load of the house.

A layer of aluminum (typically aluminum foil) is commonly used as the reflective material, as it is efficient at not transmitting radiant energy into the attic environment. The aluminum foil used in radiant barriers must be very pure to achieve a low emittance surface. The thickness of the aluminum does not affect performance; the aluminum only needs to cover the surface of the sheathing material. Typically, very thin foils (approximately 0.00025 inches thick) are used. As this foil is too thin (and thus too fragile) to be applied to wood structural panels directly, it may be attached and bonded to another substrate, most often Kraft paper, for support. The combined overlay is then laminated to one side of a wood structural panel face to make the radiant barrier sheathing. As an alternative to foil, a very thin layer of aluminum (or similar metal) can be deposited via vapor deposition manufacturing processes onto a polyethylene sheet (PET) to form a metallized PET sheet. Like foil, the metallized PET sheet can be laminated to Kraft paper, and the combined overlay is laminated to one side of a wood structural panel face to make the radiant barrier sheathing.

In several additional embodiments, end pieces 400 of the present system (i.e., the integrated panels that are installed at or adjacent to the roof of the ridge) comprise vents 410 or other ventilation means installed or integrated with the panel at the factory (i.e., during the manufacturing process). In the embodiment shown, the vents are formed by rectangular sections of longitudinal cuts made along the panel or plank. The cuts may be similar to a vented soffit, but the surface of the cut area is coated with a water-resistant finish. The vents may be located along the upper part of the plank (i.e., proximate the ridge of the roof), which permits coverage by felt fabric and ridge cap.

Installation of the end piece may be done to match the edge of the ridge. The integrated ventilation system saves time and labor, as it allows installers to simply place the end piece by the ridge without leaving gaps (which would need to be measured) or being sawn. The factory-installed vents also create a more controlled and energy efficient roof ventilation system.

Figure 21:
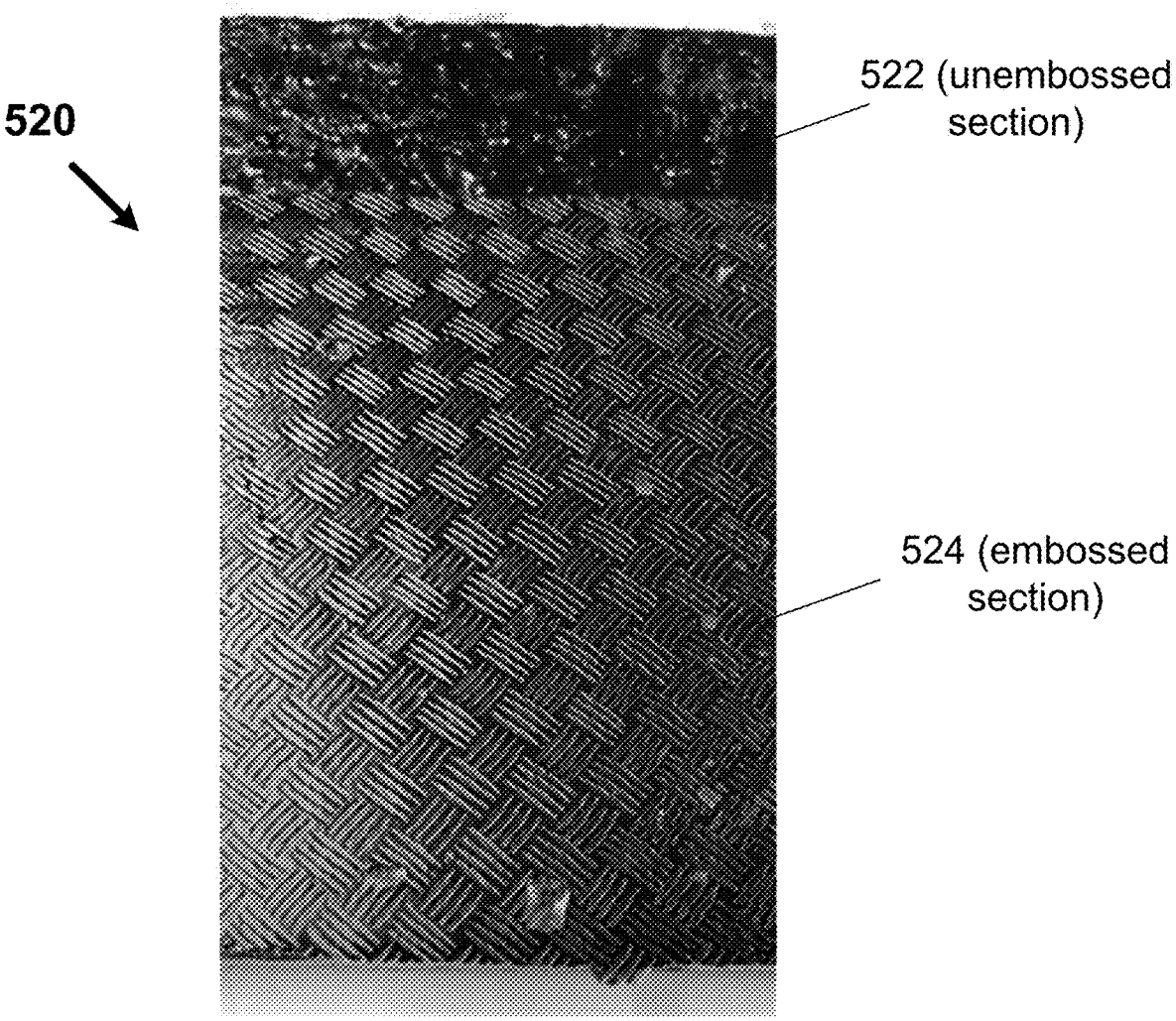
FIG. 21 shows a view of embossed silicone coating.
Figure 22:
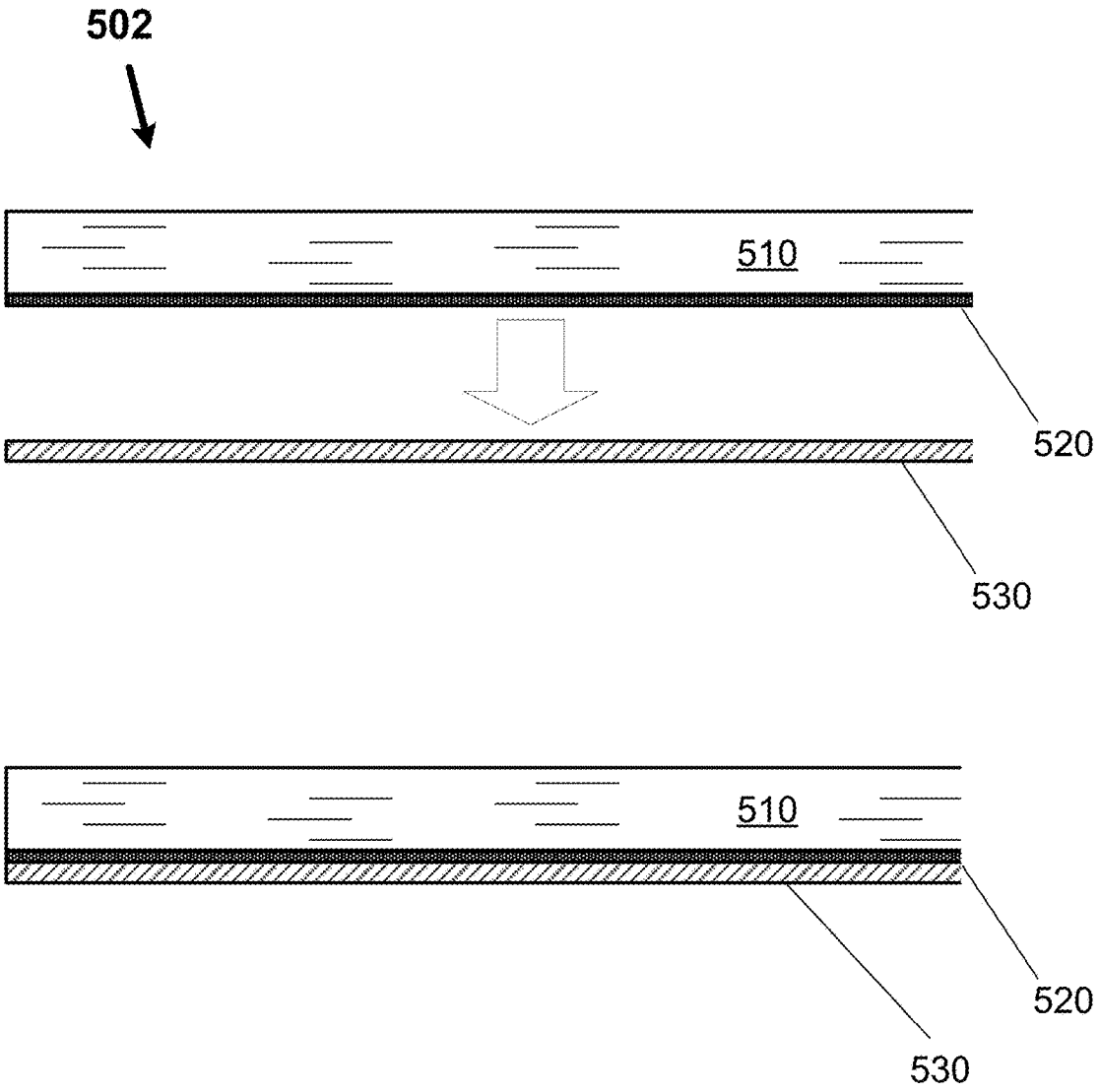
FIG. 22 shows a section view of a roofing panel with silicone layer being embossed.

In one exemplary embodiment, as seen in FIGS. 21 and 22, silicone 120 is used as part of the integrated roofing panel or plank 2. Silicone is bulk water resistant, while also being air vapor or gas vapor permeable. In various configurations, silicone may be directly applied to the OSB or wood-based substrate of the panel, silicone may be applied to a paper overlay applied to the panel, or silicone may be applied to a separate WRB layer applied to the panel. As discussed above, the silicone may or may not be mixed with or coated with sand or other forms of granular or solid material, which may provide slip or skid resistance and/or an aesthetic texture or appearance.

The silicone coating typically has a shiny, rubber-like appearance 122 that can be a detriment due to this unaesthetic appearance. The present invention solves this problem by embossing 124 the silicone during manufacturing. The silicone 120 is applied to the surface of the roofing panel or plank, and then is placed on a plastic surface or plaque 120 with a pattern (or the plastic surface or plaque with the pattern is applied to the silicone), while the silicone is still at least semi-fluid and not fully cured. FIG. 3 shows the roofing panel or plank inverted, with the top layer with silicone on the bottom in the process of being placed on the embossing surface. The plastic surface comprises a polymer or other material that does not bind to silicone. After the silicone has become fully crosslinked, the patterning plaque 130 is easily separated from the roofing panel or plank, leaving the pattern or design 124 from the plastic surface or plaque embossed in the silicone which is now part of the roofing panel or plank. The embossment may be used alone, or in combination with the introduction of sand or other forms of granular or solid material, as discussed above. The embossed pattern is intended to provide an aesthetic appearance to the outer surface, and is not intended to provide additional traction or increase the coefficient of friction of the outer surface. In some embodiments, however, the pattern may provide additional traction or increase the coefficient of friction of the outer surface as a secondary effect.

The silicone coating may be applied in a thickness of approximately 5 to approximately 30 mils. The thickness may depend on the intended use. Panels for use with storage sheds or the like, for example, may have a silicone thickness of from approximately 10 to approximately 20 mils, or preferably approximately 14 to approximately 15 mils. For residential or light commercial use, in contrast, the panels may have a silicone thickness of from approximately 20 to approximately 25 mils. In some embodiments, waterproof materials such as acrylics or fiberglass may be used in place of silicone.

Several embodiments of a novel and unique process for manufacturing an integrated roofing panel coated with silicone (applied to portions, such as the top and sides, of the roof sheathing) are described below.

Figure 23:
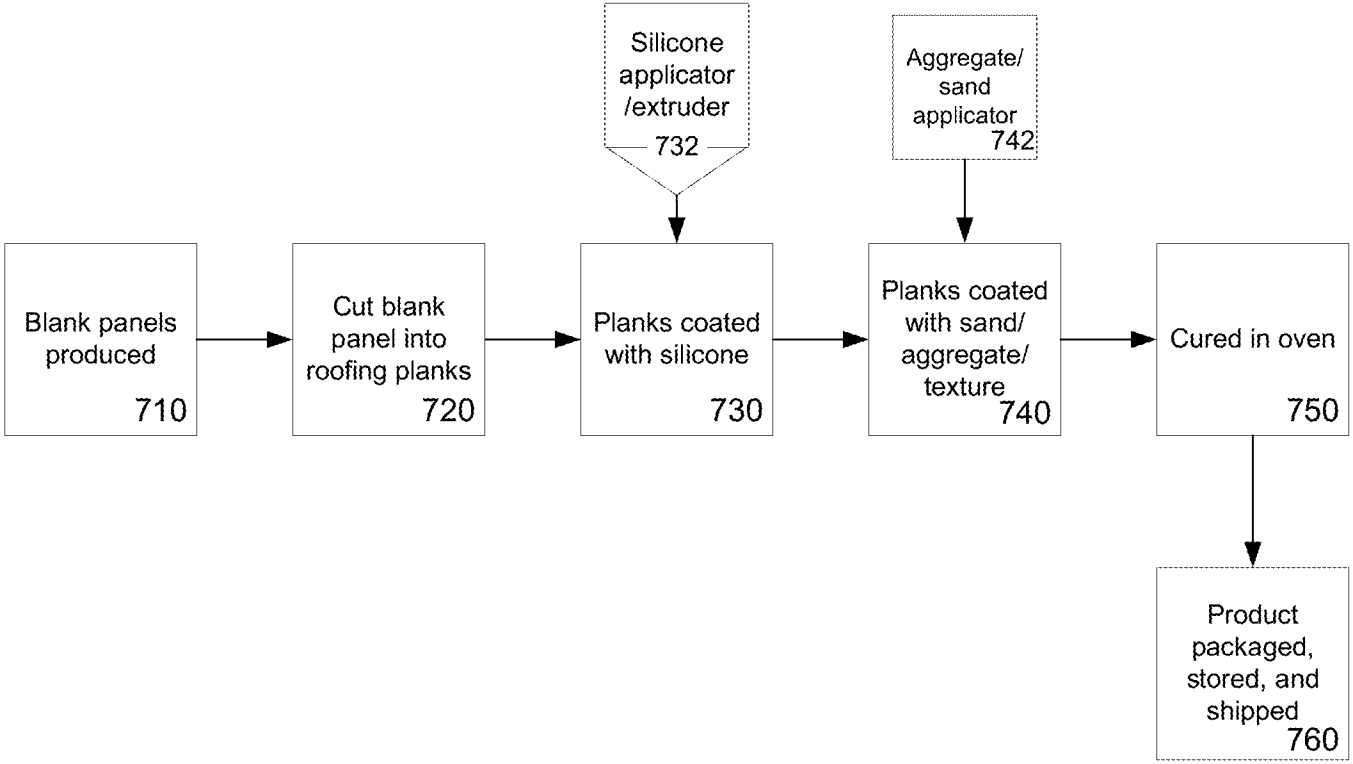
FIG. 23 shows a diagram of a production or assembly line process in accordance with an embodiment of the present invention.

In the exemplary embodiments shown in FIG. 23, blank panels are manufactured 710. Blank panels are defined as uncut or oversized panels produced by an engineered wood manufacturing process, as described in the references above. Each blank is cut into multiple roofing planks or roofing panels (hereinafter referred to as "roofing planks" or "planks") 720. The size (e.g., length, width, thickness) and orientation of the planks may vary, depending on the particular end use. Each plank may be cut with a specific profile (e.g., standard plank, starter plank, crown plank, or other profiles), which can be applied to the roof of a structure (e.g., house or shed). Planks may be cut with one or more saws or other tools according to standard wood remanufacturing processes as known in the art.

The number and orientation of the planks as cut may be based on the wood grain orientation in the panel. For example, the planks may be cut so that the wood grain orientation with respect to the long side of the panel is maintained with respect to the long side of the planks. The opposite orientation may be desired for some applications. Each blank is then subjected to further processing, as described below.

Next, the planks cut from the blank panels are coated with a silicone-based coating 730 on one or more sides and/or edges. Uncoated planks are conveyed on a conveyor belt or line under a coating applicator or extruder 732. Silicone is a waterproof and durable material after it is applied, but the application of silicone is significantly different and more difficult in this process. In particular, the spray application of silicone, as is known in the art, is difficult in this manufacturing environment. Instead, in one embodiment of the present invention, the silicone is either curtain coated on the planks from the cut blank panel, or extruded (slot die) as a flat sheet, which is laid on the planks cut from the blank panel passing underneath the extruder on a processing line or belt. Excess silicone may be recycled and reused in the process.

After coating the planks from the cut blank panel with silicone, aggregate, sand or similar texturizing material 740 is applied to the outer or upper surface of the silicone on the plank. The aggregate, sand or similar texturizing material provides an appealing surface texture, reduces gloss, and increases the grip or traction of the surface. The material may be applied with a feeder, a shaker, or a screen applicator 742. In a preferred embodiment, fine grit sand or aggregate in a range between approximately 10 mesh to approximately 40 mesh is used for providing texture while remaining in the visible area of the surface.

After application of sand/aggregate, the coated planks are cured in a high humidity, moderate temperature oven 750. In one exemplary embodiment, the oven operates between 100-125 degrees F., and from 50 to 90% relative humidity. In order to prevent condensation on the surface of the silicone, the product may be heated during a warm-up period before high humidity is provided. If the relative humidity has to be below 95%, the warm-up period can be avoided. Curing time is approximately 10-45 minutes. In one embodiment, the curing time is approximately 30-45 minutes.

Finally, the cured product is graded, packaged, stored and/or shipped 760. Typical processes known in the art for similar products may be used.

Figure 24:
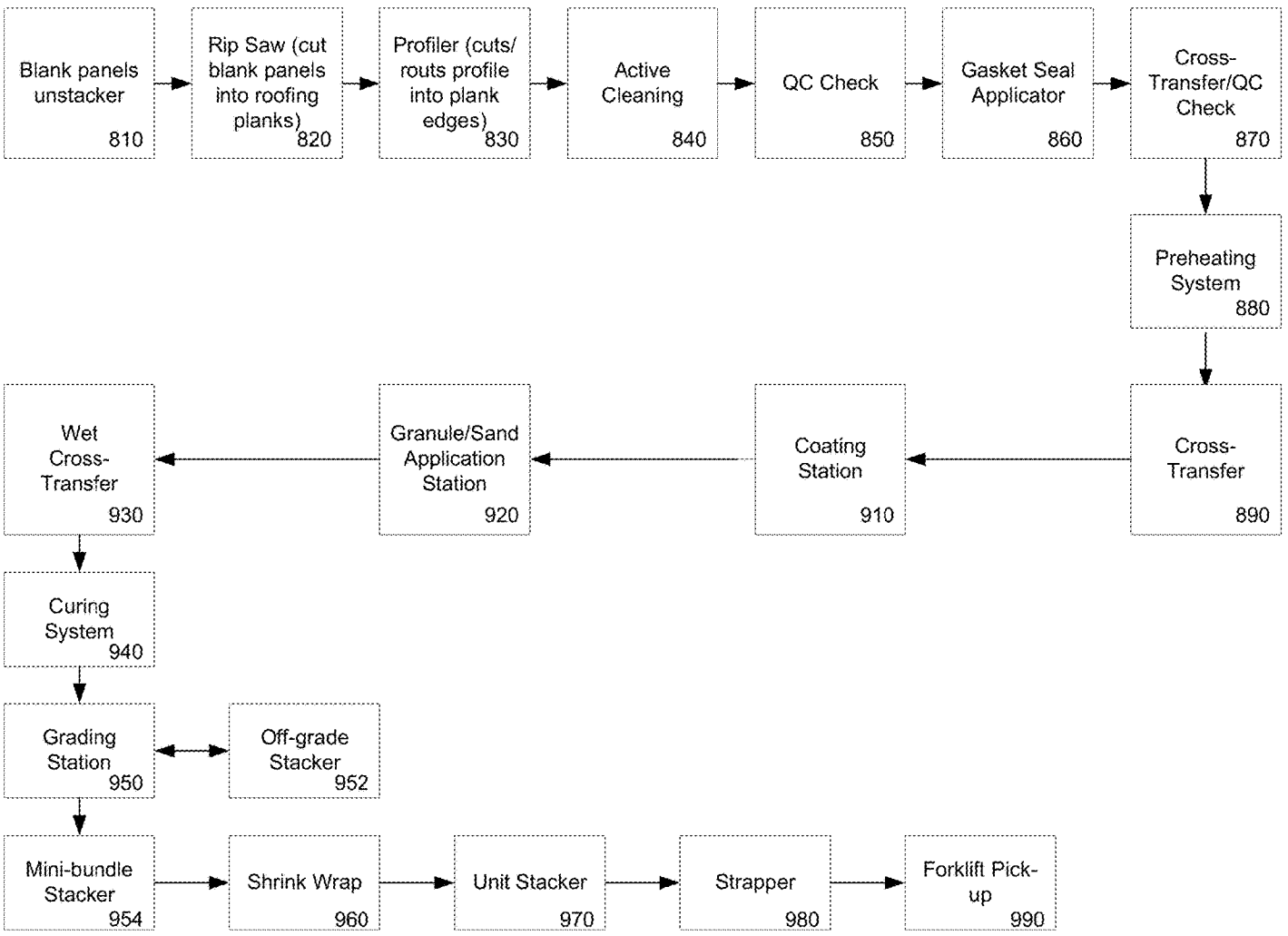
FIG. 24 shows a diagram of an alternative production line process in accordance with another embodiment of the present invention.
Figure 25:
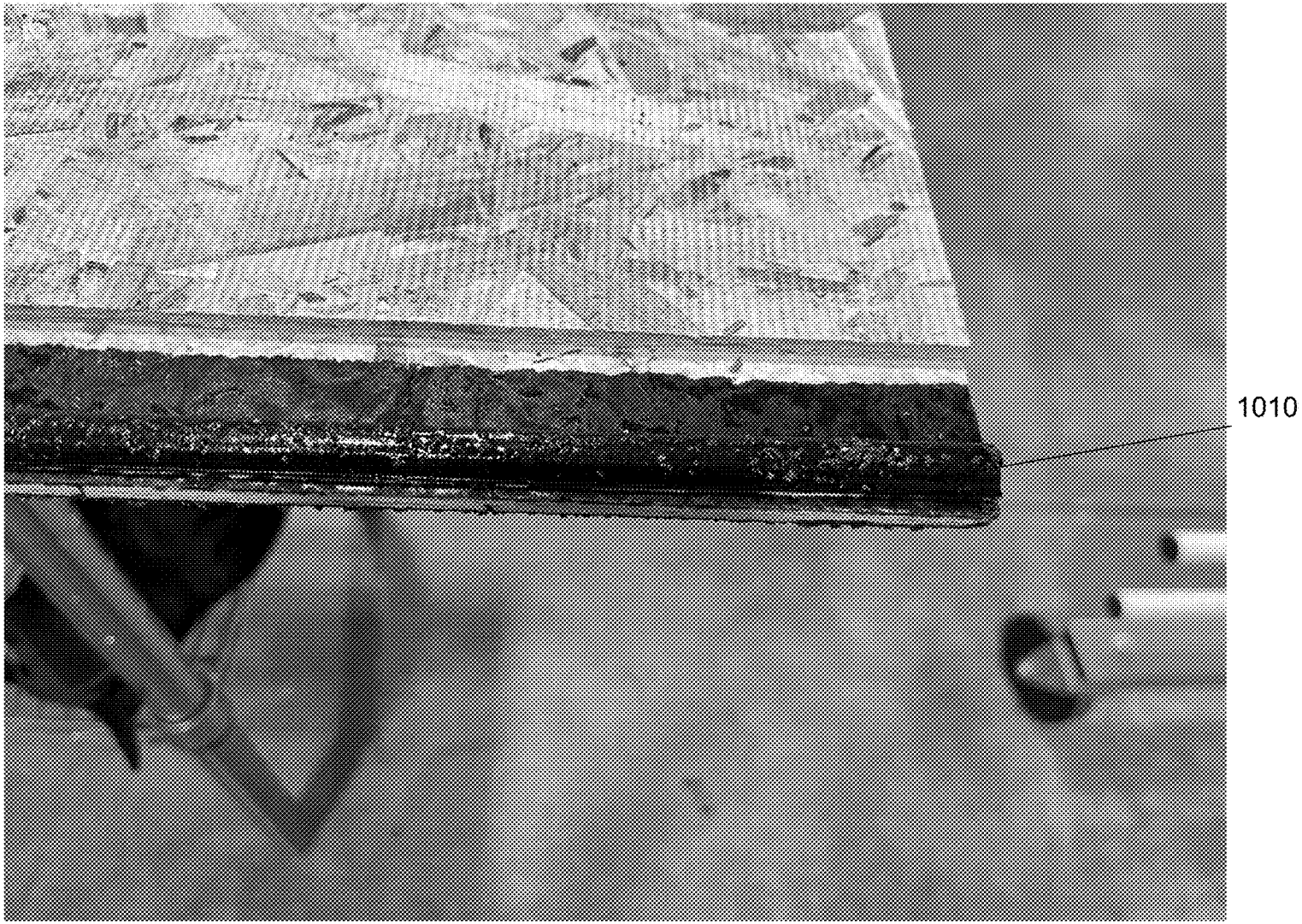
FIG. 25 shows a top perspective view of a gasket strip on the overlap section.
Figure 26:
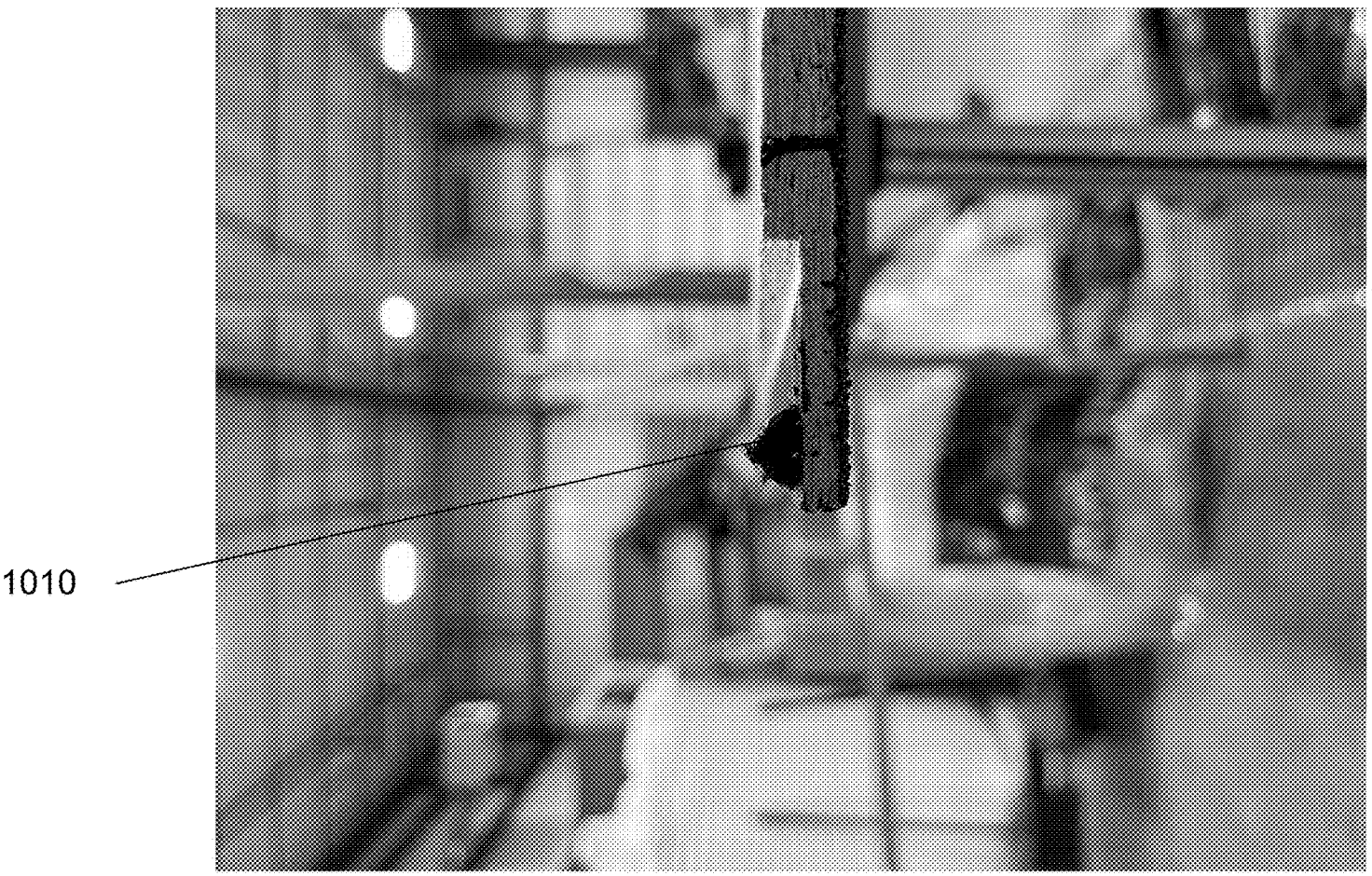
FIG. 26 shows an end view of FIG. 25.
Figure 27:
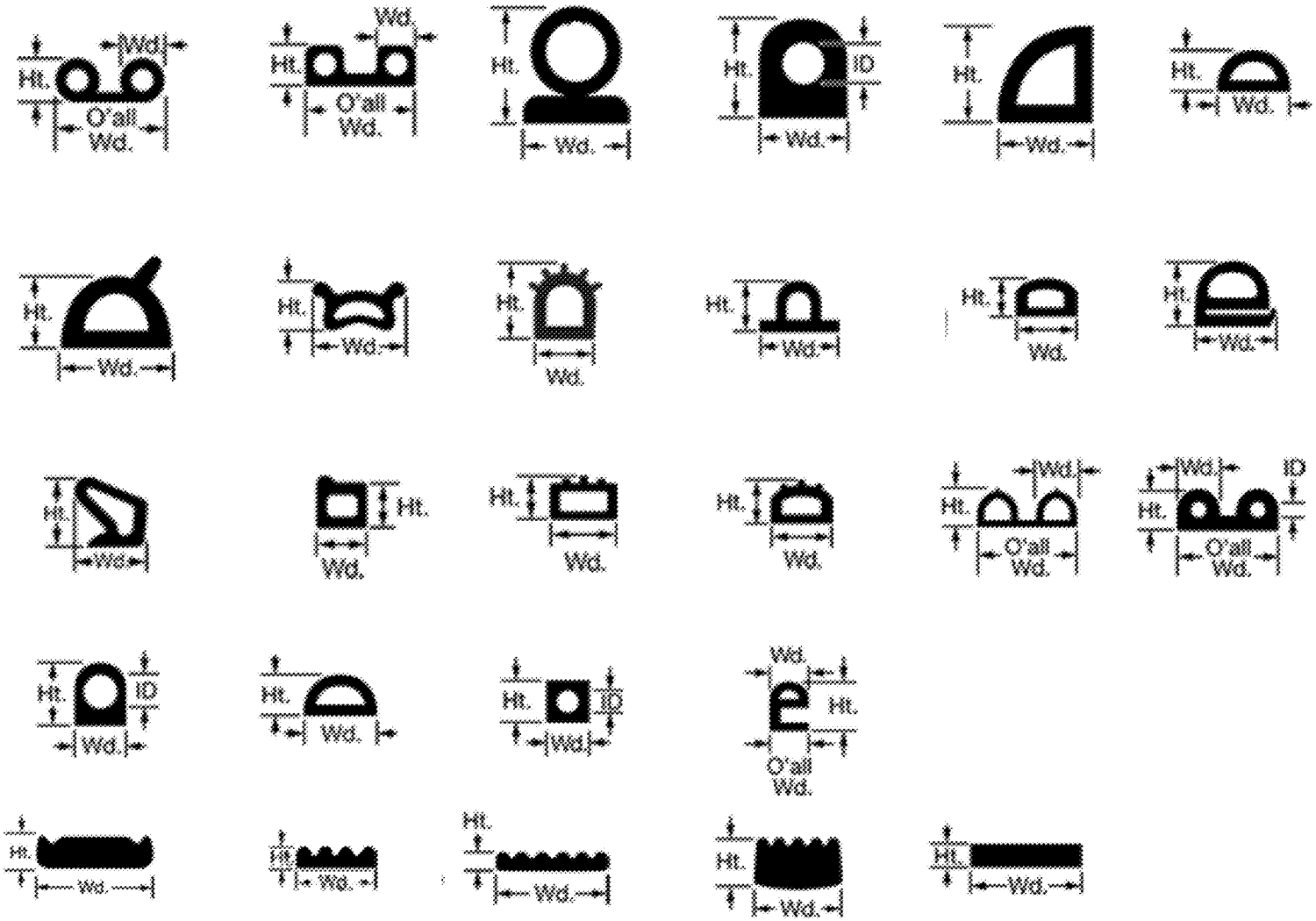
FIG. 27 shows a variety of different cross-sectional shapes for a surface-mount seal or gasket.
Figure 28:
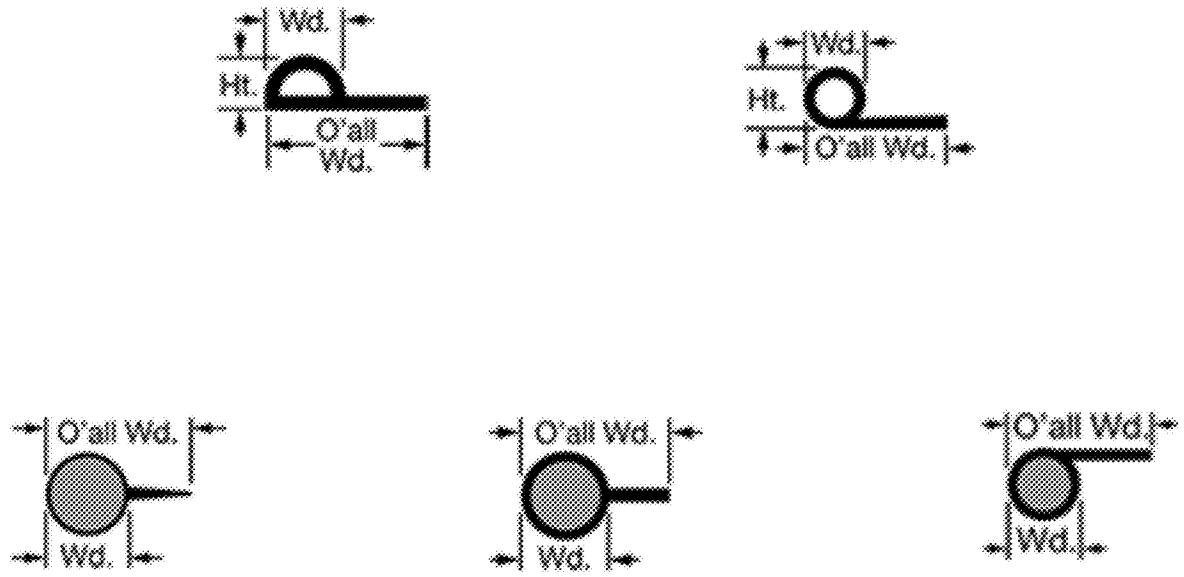
FIG. 28 shows another variety of different cross-sectional shapes for a flange-mount seal or gasket.

FIG. 24 shows a more detailed diagram of another embodiment of the present invention. Blank panels are delivered to the start of a production line, and are unstacked 810. A rip saw (or other saw) 820 is used to cut the blank panel in roofing planks or panels of desired dimensions, as described above. A profiler 830 is used to cut or rout a desired profile into the plank edges and/or sides. The profile may include, for example, a top edge underlap profile, a bottom edge underlap profile, a top edge profile for a crown plank, or a bottom angled drip edge profile for a starter plank. The planks are then cleaned 840, and undergo a quality control (QC) check 850. Planks that pass the QC check then have one or more gasket seals, such as D-gasket seals, affixed or adhere to appropriate locations (e.g., on the face of an underlap profile or the face of an overlap profile) 860. After a second quality control check, the planks are then cross-transferred 870 to a preheating system 880. The preheating system 880 heats the plank(s) in preparation for the coating process. Preheating may be provided by a heating lamp, heating tunnel, an oven, or similar means.

After preheating, the planks are cross-transferred 890 to a second production line for coating 910 and the addition of aggregate (e.g., granules, sand) 920. At the coating station 910, the planks are coated, as described above, with a silicone-based coating formulation on one or more sides and/or edges in a humidity-controlled environment. Coating techniques include, but are not limited to, curtain coating, spray coating, slot-die coating, extrusion coating, slide coating, rolling coating, and dip and brush conformal coating methods. These methods facilitate the application of binders in the coating on the engineered roofing structural panel.

Binders are a part of the coating's makeup as used in the present invention, and include organic polymers and/or inorganic geopolymers to hold the pigments or colorants in place and bind all the ingredients together to provide a coated roof system with excellent waterproofing and weatherproof properties. Organic polymers in the coating may comprise resins or adhesives, such as, but not limited to, epoxy, alkyd, acrylic, urethane, silicone, phenolic, silicone—epoxy hybrid resin, fluoropolymer, acrylic—fluoropolymer mixtures, and the like. Geopolymers in an inorganic binder system may comprises sodium silicate, potassium silicate, aluminosilicates, zinc phosphate, and similar materials. In several embodiments, the coating formulation may use a resin or adhesive other than a silicone resin.

Binder (e.g., silicone resin as applied here) may be supplied in totes, mixed before feeding, pumped to a day tank with mixing and heat blankets, and pumped to the coating station (e.g., curtain coater) with a recirculation pump. As discussed above, this binder preparation process should be enclosed in a humidity-controlled environment.

Various colorants added into or with binders provide coatings with excellent appearance, aesthetics and functionality. A non-limiting example is adding carbon black into the binder system to provide better hiding power, color stability, solvent resistance, abrasion resistance, acid and alkali resistance, as well as thermal stability.

After coating, an aggregate (e.g., granules, sand) is distributed on the binder surface by an applicator, such as a vibratory feeder 920. The granules or sand are mixed separately, and placed in a collection or supply bin. A screw feeder feeds the granules or sand to the vibratory feeder located above the plank(s). Excess granules or sand that do not adhere to the binder surface are collected and return conveyed to a collection bin, and may be reused.

Subsequently, the planks are wet cross-transferred 930 to a curing system 940 to cure the silicone-based coating. In general, the curing system comprises a humidity-controlled drying oven or light-based (e.g., UV ray) curing apparatus. Curing methods include thermal curing with heat, heating in conjunction with in-process adding or post-adding of curing agents and hardeners, visible light (e.g., ultraviolet (UV) rays in the 350-380 nm range), moisture curing (humidity and atmospheric curing), hybrid curing under heat at different levels of moisture, and similar techniques. The curing techniques used are dependent on the type of binder formulation and system used.

After curing, the planks are graded at a grading station 950. Planks that do not meet the grading standard (i.e., "off-grade") are sent to an off-grade stacker 252 for later processing. Planks that meet the requisite grade are send to a mini-bundle stacker 954, where a suitable number of planks are bundled together in a stack. The stack is then shrink-wrapped 960, and sent to a unit stacker 970 where multiple shrink-wrapped bundles are combined to form a unit. The stacked bundles forming the unit are then strapped 980 together, and transported by a fork-lift or other transport machinery to a storage location for further processing and shipping.

In several embodiments, as described above, the integrated roofing planks or product overlaps with adjacent planks along one or more edges. For example, the upper edge of a plank may form the underlap of a lap joint, while the lower edge then forms the overlap element. In several additional embodiments, a sealing D-gasket 1010 is placed on the overlap element. When the overlap joint is formed, the D-gasket 1010 seals the joint, thereby preventing potential water intrusion.

While the D-gasket 1010 may be placed on the overlap element before or after general coating of the roofing plank, in a preferred embodiment it is affixed to the overlap element prior to coating. The D-gasket may be adhesively affixed, such as by an adhesive backing or an adhesive tape with a liner. The D-gasket may be applied in the factory production line.

After the D-gasket is set in place, the roofing plank may then be coated as described above, such as with silicone. The coating may be applied to the gasket as well, as this improves the attachment of the gasket to the roofing plank as well as providing an additional seal against water intrusion. A further advantage of coating the gasket with silicone is that this generates a bond with the matching silicone-coated face of the underlap element of the adjacent panel, providing yet additional sealing against water intrusion after installation.

Yet another advantage is that the D-gasket allows for immediate transportation of a structure with a roof (such as a shed) or a portion or section of a roof, as the D-gaskets help seal the roofing panels and material in place. Standard roofing shingles adhesively affixed to a similar structure would require substantial curing time under heat before the structure could be moved or transported.

While the D-gasket has been described above as being placed on the overlap element, it may also be placed on the underlap element. In some embodiments, a gasket may be placed on both elements.

A novel and unique process for manufacturing an integrated roofing panel with a D-gasket and coated with silicone (applied to the top and sides of the roof sheathing) is described below.

First, blank panels are manufactured. Blank panels are defined as uncut or oversized panels produced by an engineered wood manufacturing process, as described in the references above. Each blank is cut into multiple roofing planks. Each plank may be cut with a specific profile, which can be applied to the roof of a structure (e.g., house or shed). The specific profile includes an underlap element and an overlap element along opposite edges. Planks may be cut with saws or other tools according to the standard wood remanufacturing processes as known in the art.

Second, a D-gasket (e.g., D-bulb EPDM, silicone or similar materials) is affixed to the face of the overlap or underlap element on each plank. While the distance from the edge may vary, in one element embodiment the D-gasket is installed ⅛" from the outer edge of the lap element.

Third, after installation of the D-gaskets, the cut blank panels are coated with silicone. Silicone is a waterproof and durable material after application, but application is significantly different and difficult in this context. In particular, spray application of silicone is difficult in the manufacturing environment. In the present invention, the silicone may be curtain coated on the cut blank panel, or extruded (slot die) as a flat sheet, which is laid on the cut blank panel passing underneath the extruder on a processing line or belt. Excess silicone may be recycled and reused in the process.

Fourth, after coating the cut blank panel with silicone, aggregate, sand or similar texturizing material may be applied to the outer or upper surface of the silicone. The aggregate, sand or similar texturizing material provides an appealing surface texture, reduces gloss, and increases the grip or traction of the surface. The material may be applied with a feeder, a shaker, or a screen applicator. In a preferred embodiment, fine grit sand or aggregate in a range between approximately 10 mesh to approximately 40 mesh is used for providing texture while remaining in the visible area of the surface.

Fifith, after extrusion and application of sand, the coated panel is cured in a high humidity, moderate temperature oven. In one exemplary embodiment, the oven operates between 100-125 degrees F., and from 50 to 90% relative humidity. In order to prevent condensation on the surface of the silicone, the product may be heated during a warm-up period before high humidity is provided. If the relative humidity has to be below 95%, the warm-up period can be avoided. Curing time is approximately 10-45 minutes. In one embodiment, the curing time is approximately 30-45 minutes.

The product may then packaged, stored and/or shipped. Typical processes known in the art for similar products may be used. Alternatively, the product may be installed directly in the factory to a product such as a pre-manufactured shed, dog-house, or the like. In the later case, the roofing products are installed to form shiplap joints: the first row of panels are screwed or fastened into place, then the second row (with the bottom overlap element overlapping the first row), and so on. Each panel or plank is screwed or fastened into place during installation, which places enough pressure on the D-gasket to push the gasket down and cause it to flatten, thereby produce a complete, water-resistant seal.

Curing time may be up to 4 hours. If a catalyst is used, curing time may be approximately 20 to 30 minutes.

While the above has described the gasket as a D-gasket (e.g., D-bulb EPDM, silicone or similar materials, the seal/gasket shape and/or material can comprise other shapes and materials. For example, FIG. 8 shows a variety of different cross-sectional shapes for a surface-mount seal or gasket constructed from EPDM hollow or solid rubber or foam rubber or similar materials. FIG. 9 different cross-sectional shapes for a similar flange-mount seal or gasket. In yet a further embodiment, the seal is provided by a construction-grade hook-and-loop ("Velcro") fastener, where a strip of loop material is affixed to the overlap element as described above, while a strip of hook material is affixed to the underlap element in a corresponding position to connect with the strip of loop material. The inverse arrangement may also be used, i.e., the loop strip and the hook strip may also be positioned on the other surfaces, respectively.

Figure 29:
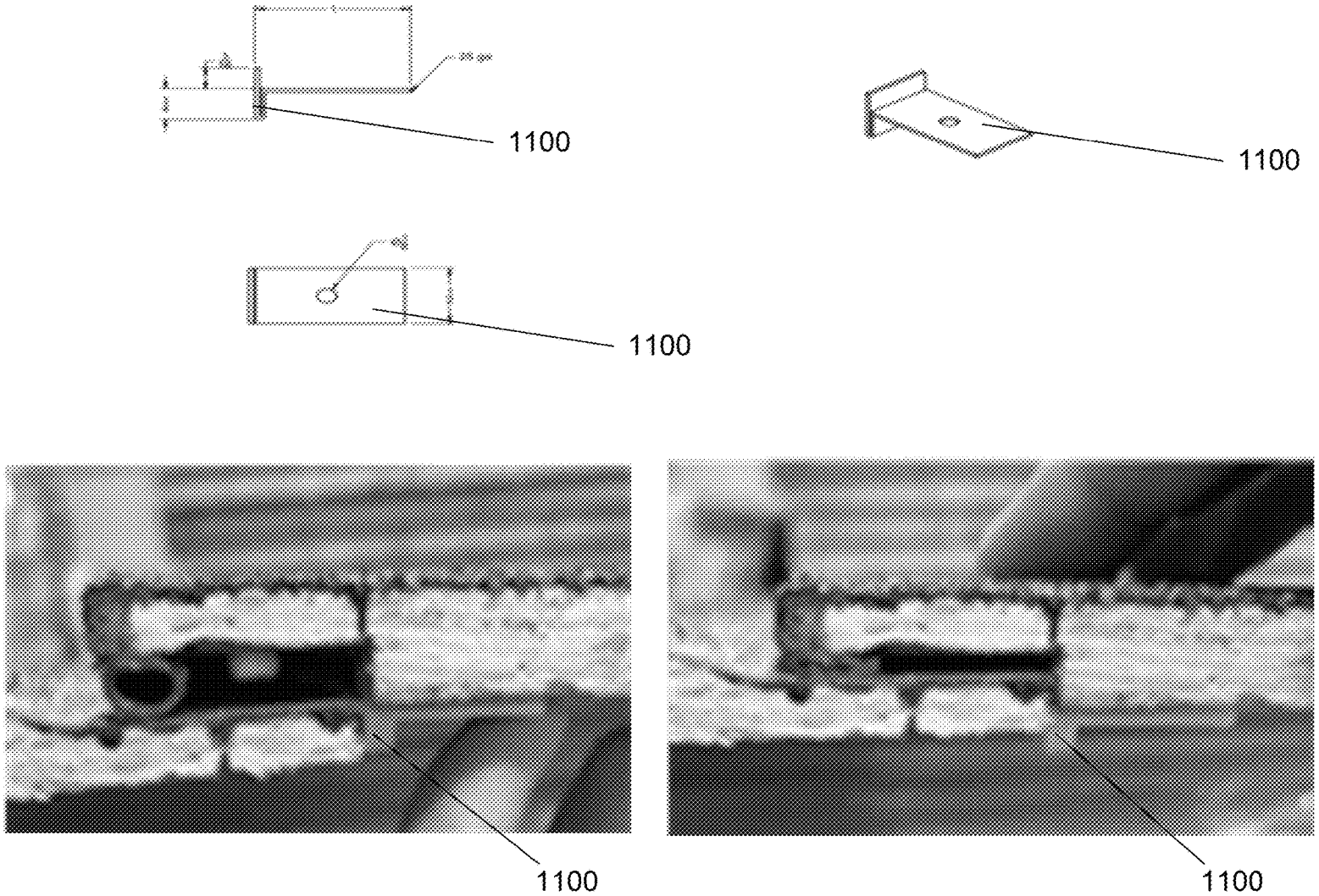
FIG. 29 shows a tack-plate for use with the present invention.

FIG. 29 shows a "tack-plate" 1100, which is installed on both end of a plank prior to installation and alignment on a roof. The plate clearly indicates the edge of the board to installers, which allows the setting and alignment of planks to be performed with confidence and greater speed.

Figure 30A:
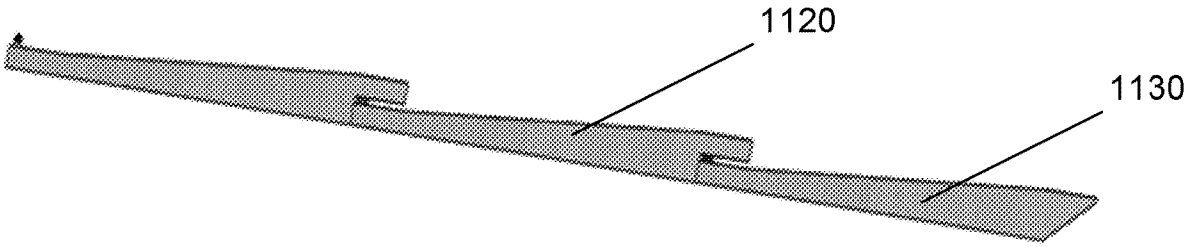
FIGS. 30A through 33C show alternative plank profiles.
Figure 30B:
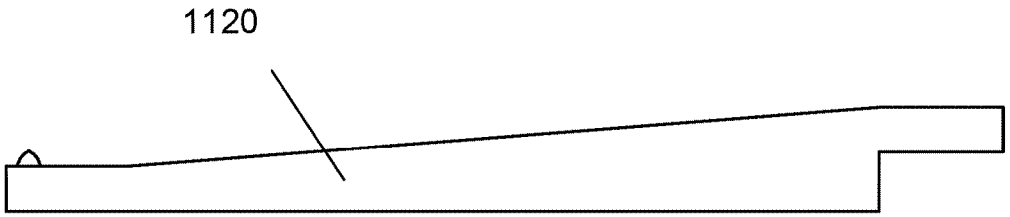
Figure 30C:
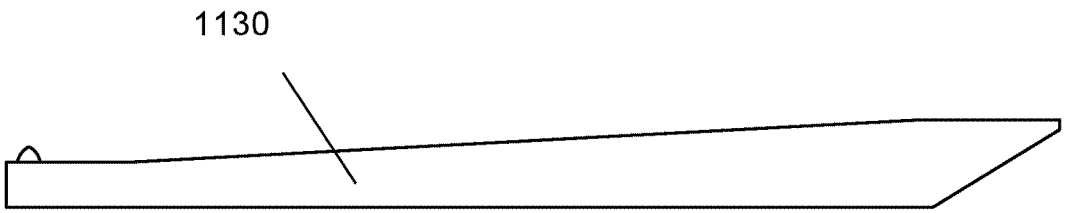

FIGS. 30A-C show alternative profiles for planks, both a standard plank 1120 (with upper underlap and lower overlap), and a starter plank 1130. These profiles increase the ability of water and fluids to flow from between the laps, thereby helping to eliminate the ponding of water therein. A smaller gasket 1010 may also be used in conjunction with these profiles, which also may eliminate the need for a tack-plate 1100. For particular ponding problems, to help resist deflection, additional metal roofing screws may be installed at the ends of the standard planks and starter planks, and penetrate the planks and go into the underlying joint.

Figure 31A:
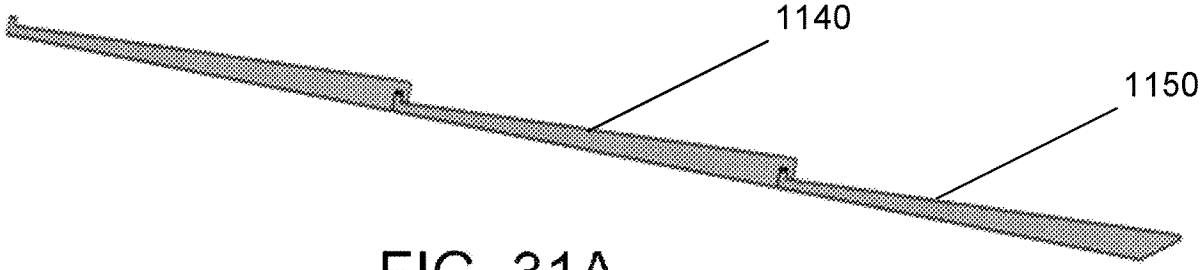
Figure 31B:
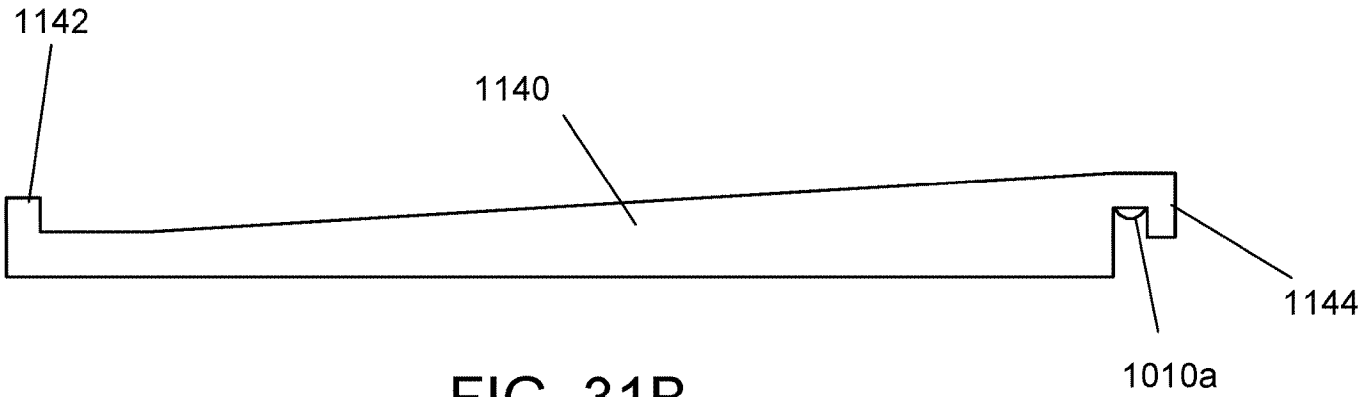
Figure 31C:
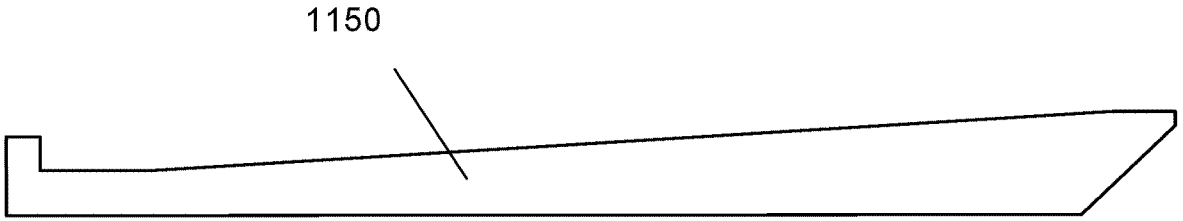
Figure 32:
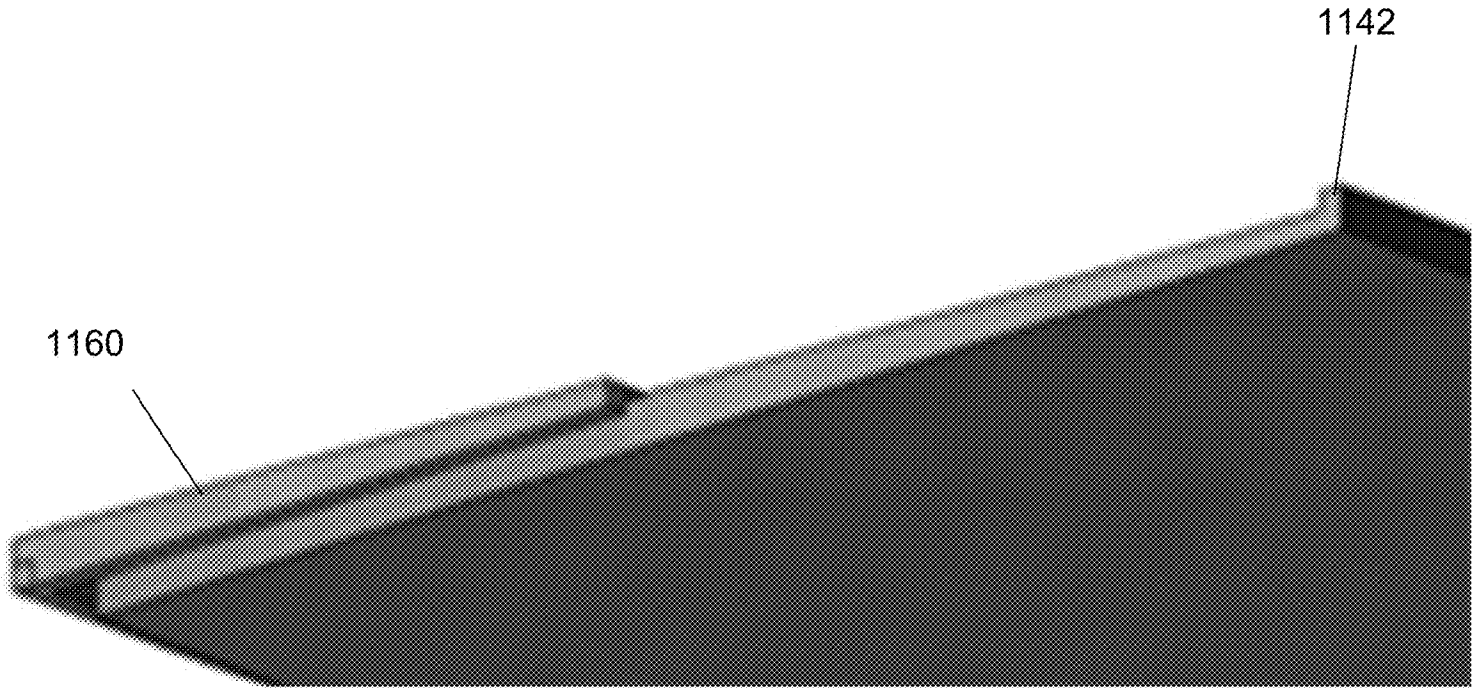

FIGS. 31A-C show another set of alternative profiles for locking planks, both a standard plank 1140 and starter plank 1150. The underlap end comprises a ridge or tab 1142 that extends upward and locks into a channel 1144 in the overlap. A small gasket 1010*a* is fixed in the channel. This arrange also eliminates water collection or ponding, and eliminates the need of a tack-plate or double drilling caused by additional screws. As seen in FIG. 32, a joint cover 1160 may be used to help prevent water leaking at butt joint areas.

Figure 33A:
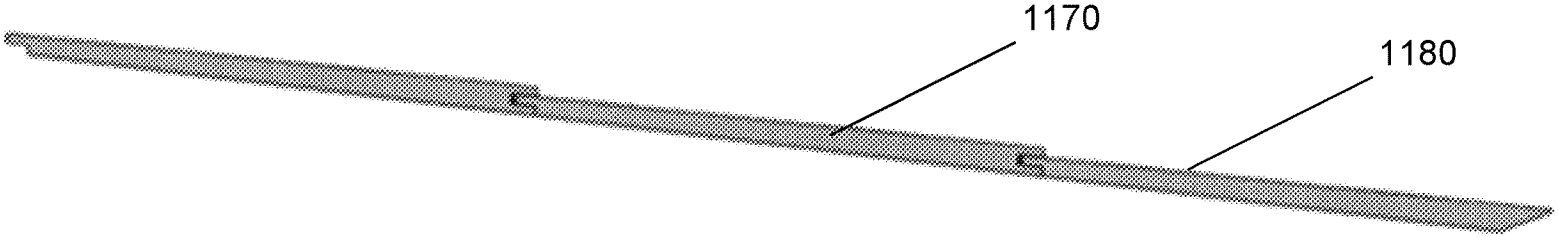
Figure 33B:
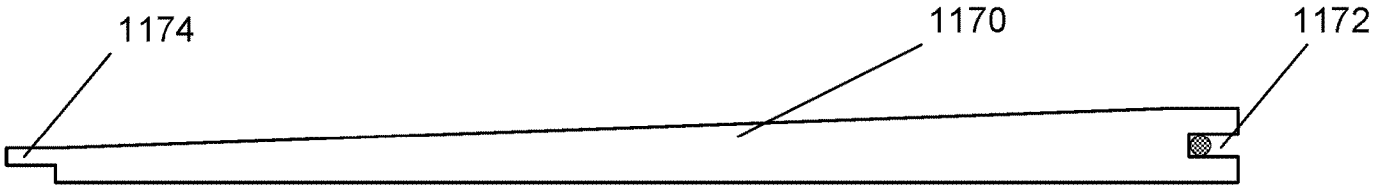
Figure 33C:
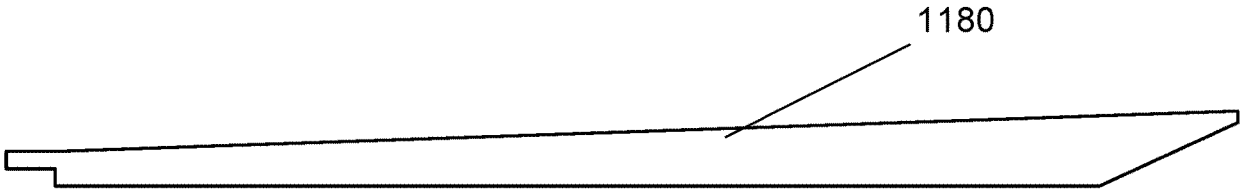

FIGS. 33A-C show an alternative modified tongue-and-groove profile design for the standard planks 1170 and starter planks 1180. This design provides benefits for butt joints and ease of granule coating. The joint has a channel 1172 cut along one edge (which may have a sealing gasket inside) and a corresponding thin projecting ridge 1174 on the other edge. When two planks are pushed together, the tongue slots into the groove along their length to give strong join with no need for glues, nails or tracks. Seamlessly fitting planks make the roof easier to clean and maintain, as dirt and dust cannot build up in recesses. The interlocking roof plank adds to the strength of the building by connecting more surface area together than boards laid one atop another, namely the present shiplap designed roof system. The added friction between boards prevents relative movement, making the roof an exceptionally study structure. The shape of the tongue-and-groove profile also prevents water seeping through joins and into the structure. A joint cover may also be used to help prevent leaking at the butt joint area.

Figure 34:
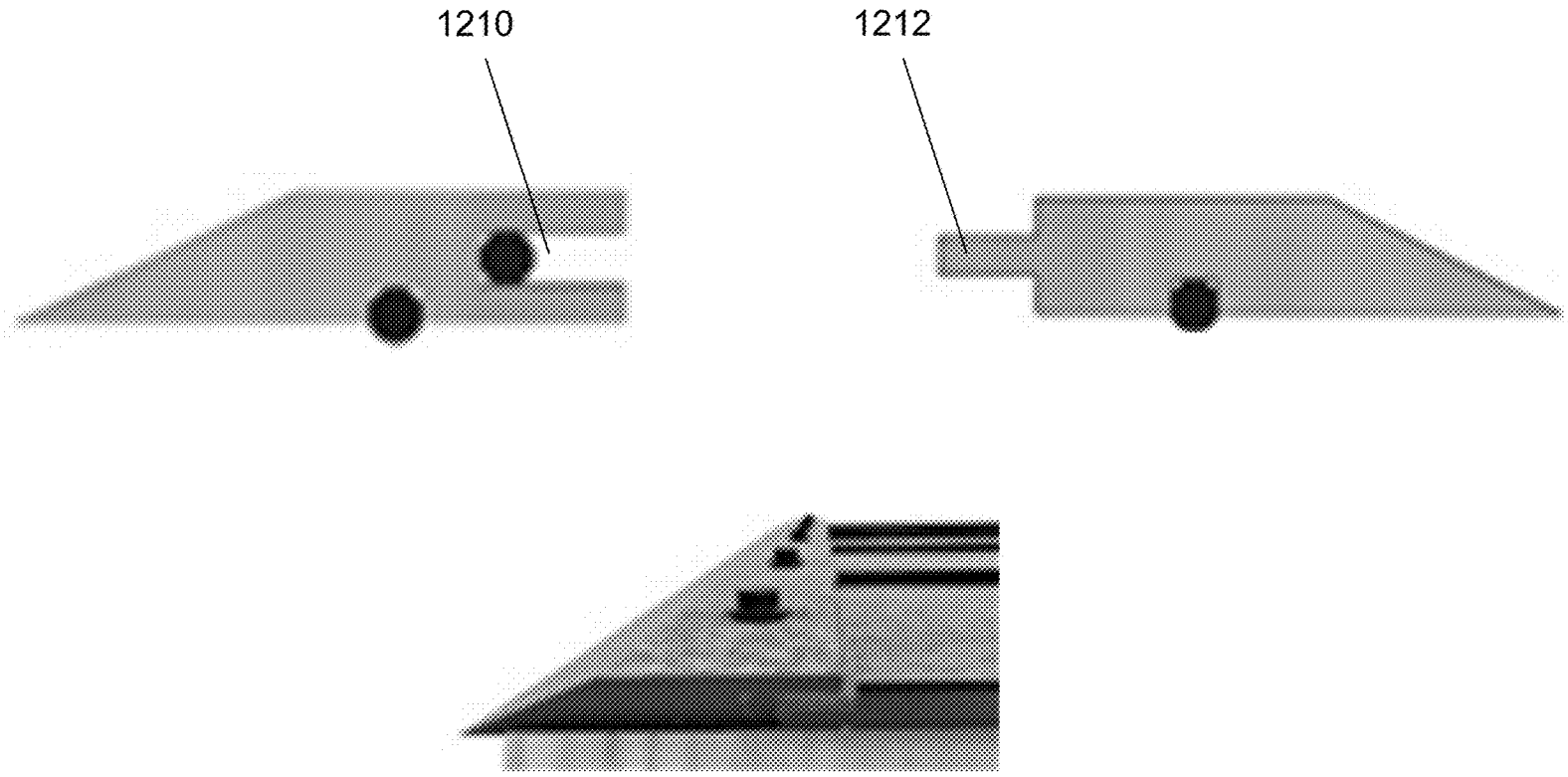
FIGS. 34-37 show alternative end-cap configurations.
Figure 35:
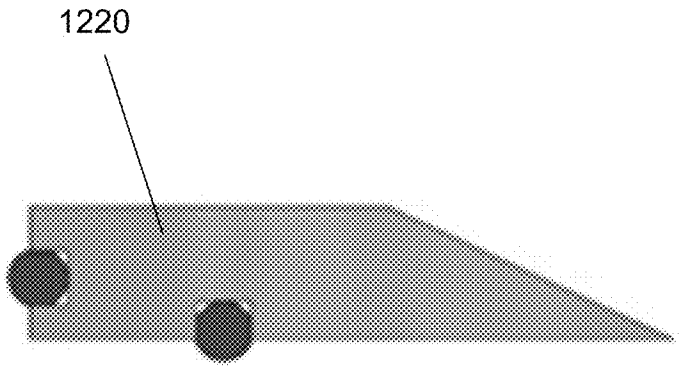
Figure 37:
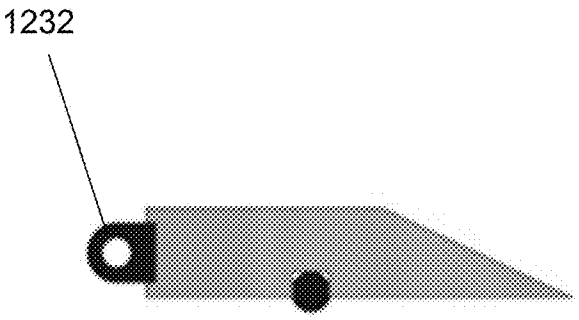
Figure 36:
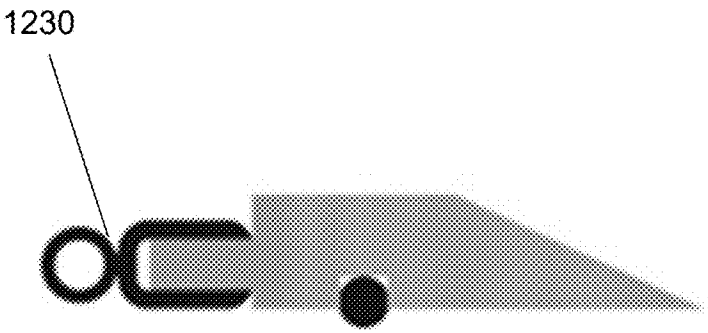

FIGS. 34-37 show examples of configurations to replace the use of traditional L-shaped end caps along the assembled roof edges. FIG. 34 shows end caps with tongue-and-groove components, where each end cap has a groove 1210 or a tongue 1212 that matches a corresponding tongue or groove on the end of the roof plank. The grooves may have a sealing gasket therein. The bottom of each cap also has a channel with a sealing gasket. FIG. 35 show a "smooth side" end cap 1220 with a shallow channel with a gasket, which can be used on both ends of the roof. The bottom of each smooth side cap also may have a channel with a sealing gasket. FIG. 36 shows a variation of FIG. 35, with the inside face comprising a hatch seal 1230 with a hollow gasket attached to and extending from a ridge on the end cap. FIG. 37 shows another variation, with a tall D-gasket 1232 affixed to the shallow channel in the smooth side.

Figure 38:
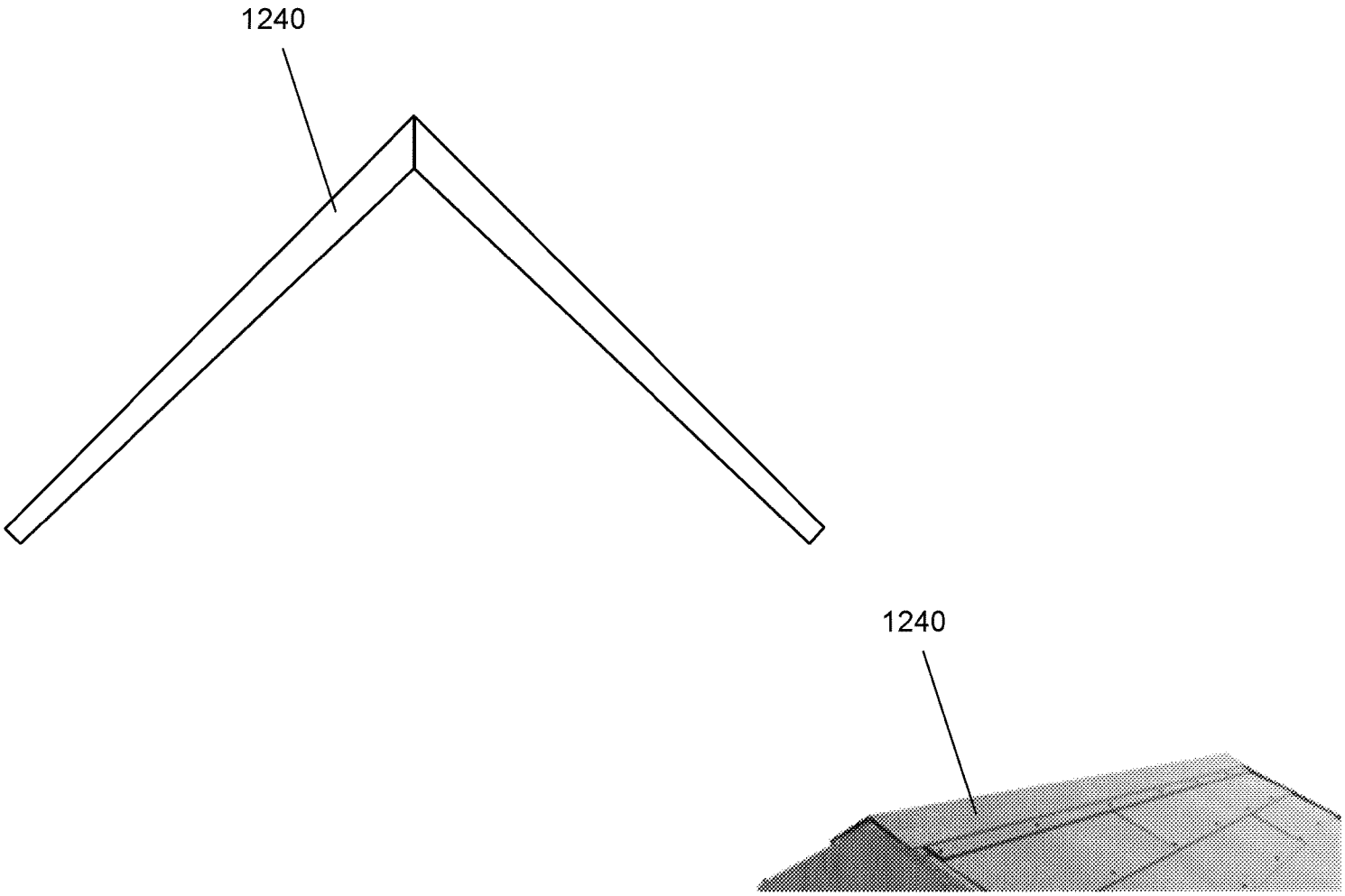
FIGS. 38-39 show an alternative ridge cap design.
Figure 39:
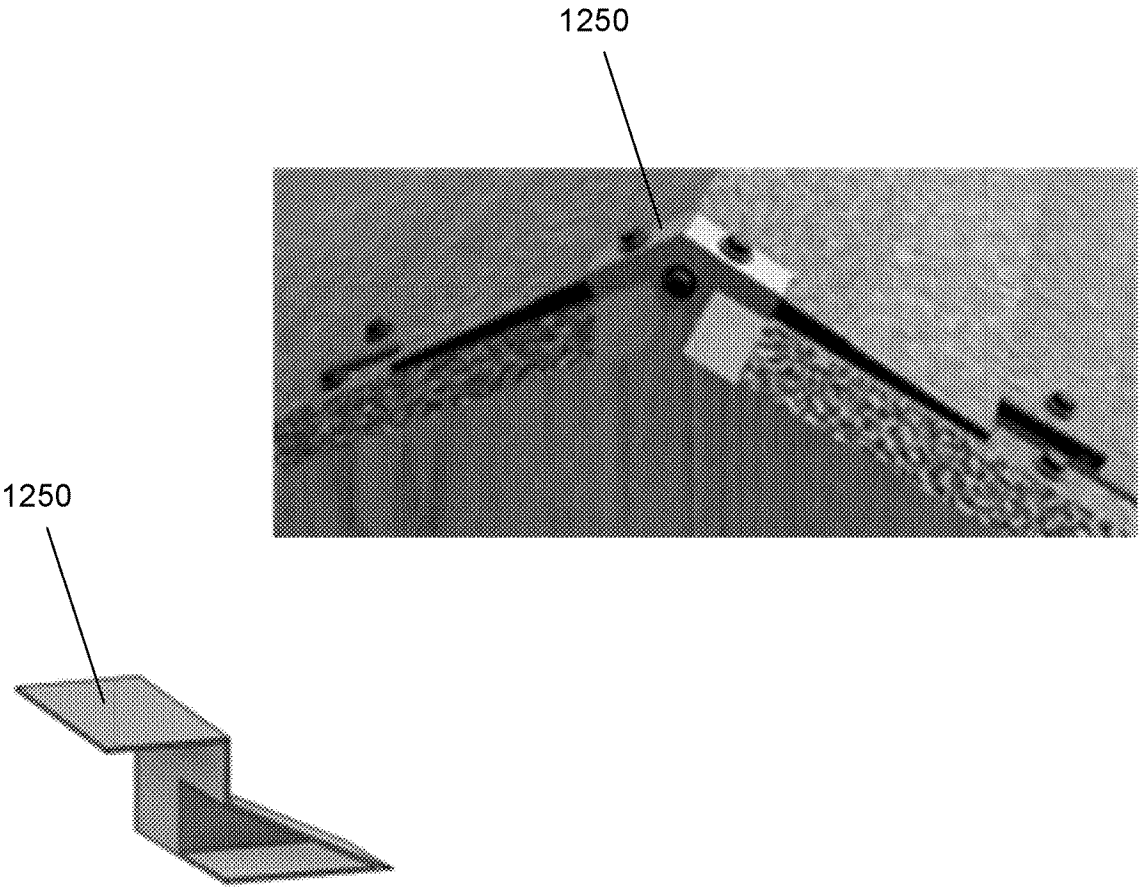

FIG. 38 shows an alternative ridge cap design replacing a traditional overhanging ridge cap. The new ridge cap 1240 is made of fabric, which gives it a better aesthetic appearance and improved water leaking prevention. Two sides of a board are joined with a waterproof fabric that is then stapled or affixed to the board and coated with silicone and granules to obtain a uniform appearance with the roof panels. FIG. 39 shows special end caps 1250 needed for left and right sides to seal the ridge cap with screws or similar fasteners.

Figure 40:
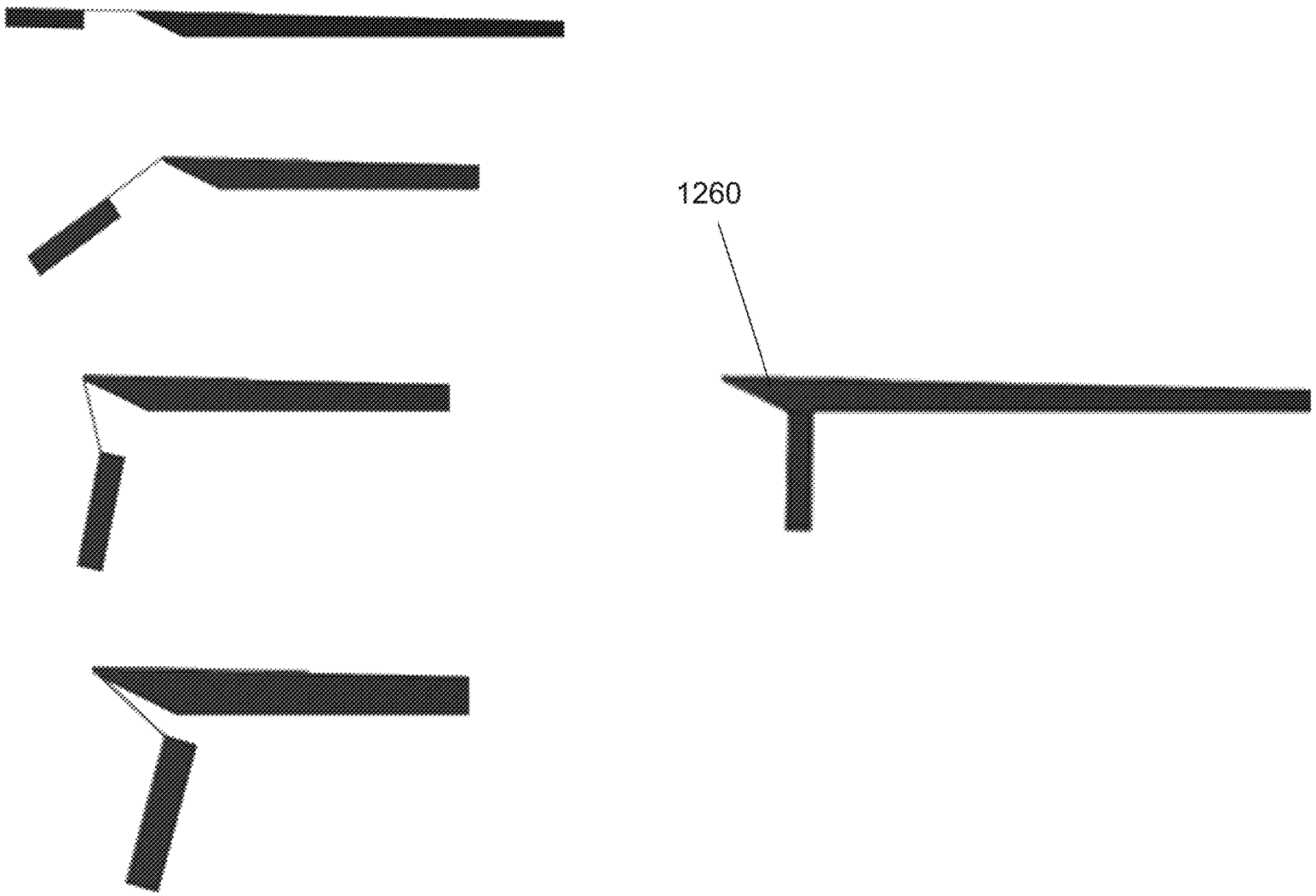
FIG. 40 shows an alternative design for an integrated drip edge.

FIG. 40 shows an alternative design for an integrated drip edge 1260, which is foldable waterproof fabric (or fiberglass, or fabric/paper) coated with granules for a better aesthetic appearance with the roof panels. It acts as a hinge, where the panel is screwed in with an additional wood piece screwed into the other side, which then hingedly pivots between the drip edge and can be attached thereunder.

Figure 41:
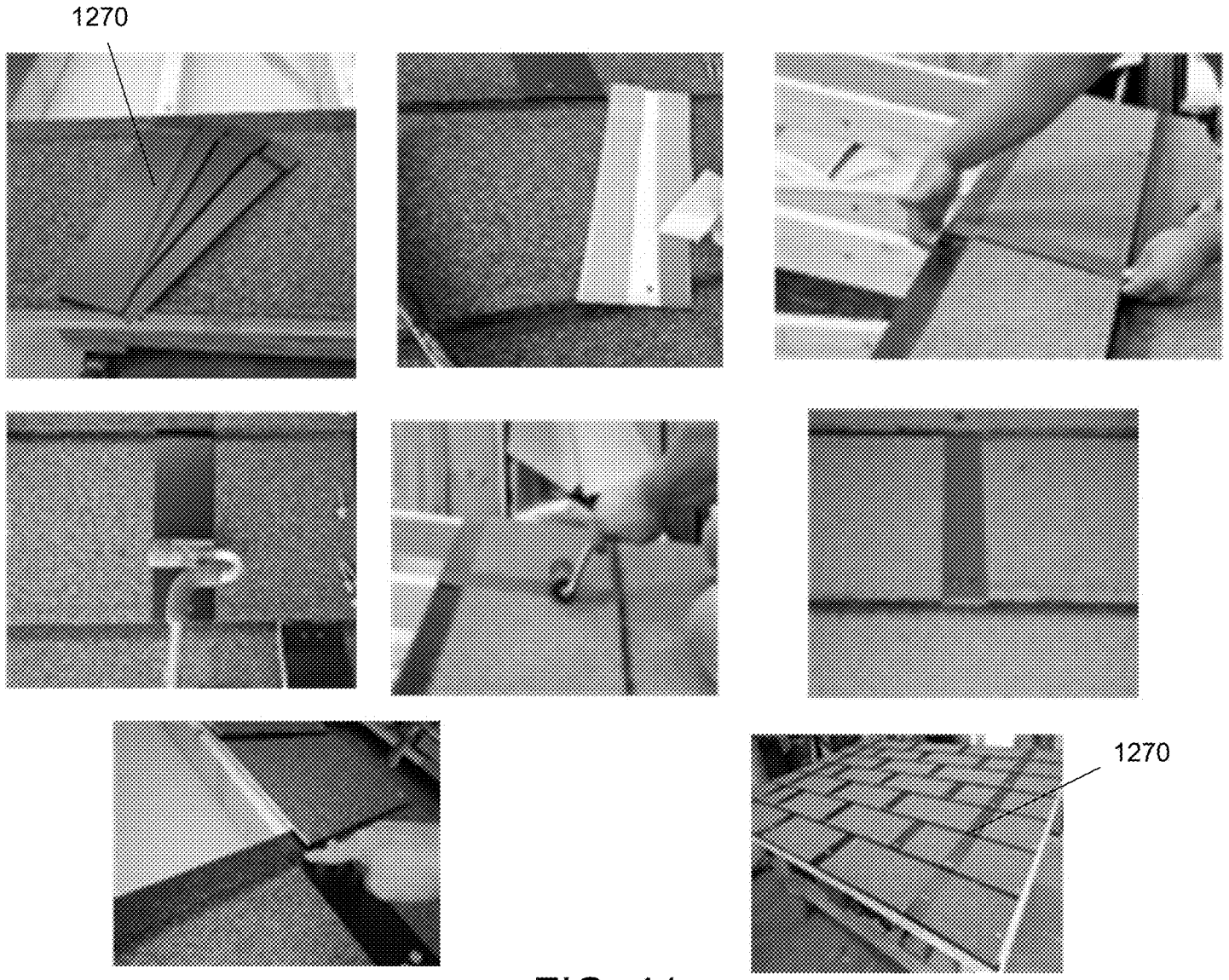
FIG. 41-43 show alternative designs for joint caps.

FIG. 41 shows a joint cap for use at butt joints between two plank ends that are in line during installation. This eliminates the need for use of a silicone sealant and rigid center seam metal cap over the joint. The caps 1270 are aluminum trim coil pieces bent to match the plank profile. A butyl-based gasket with two rows is installed by removing the release paper, tucking the lower edge in first, and then placing the cover cap flat and centered along the butt joint. Each cover cap is then rolled to ensure a good bond between the self-stick gasket material and the granules of the roof plank.

Figure 42:
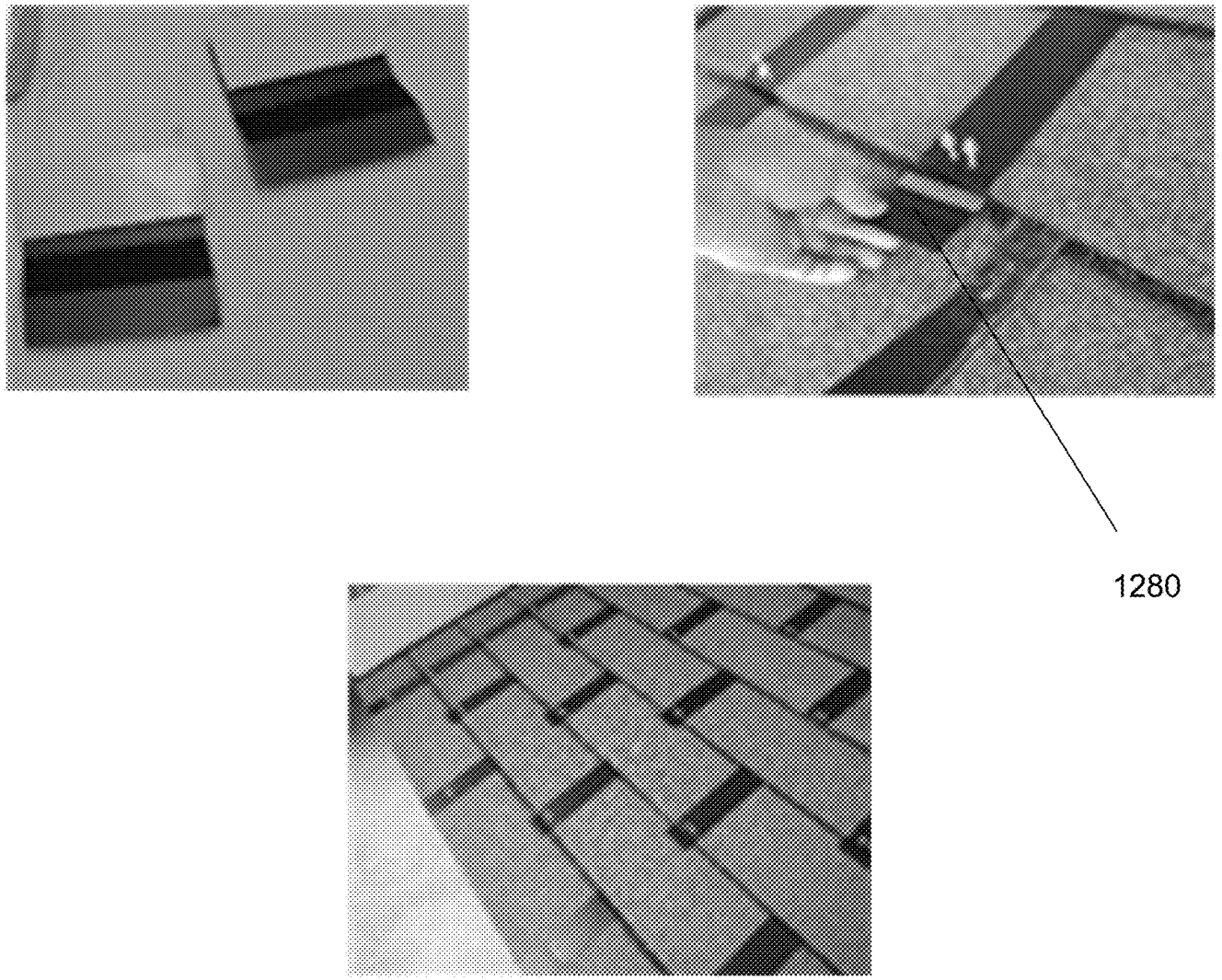

FIG. 42 shows a variation of the joint caps of FIG. 41. The butyl-based gasket is attached to the backside of the caps. A tab 1280 is added to shed water from between the plank-gasket joints.

Figure 43:
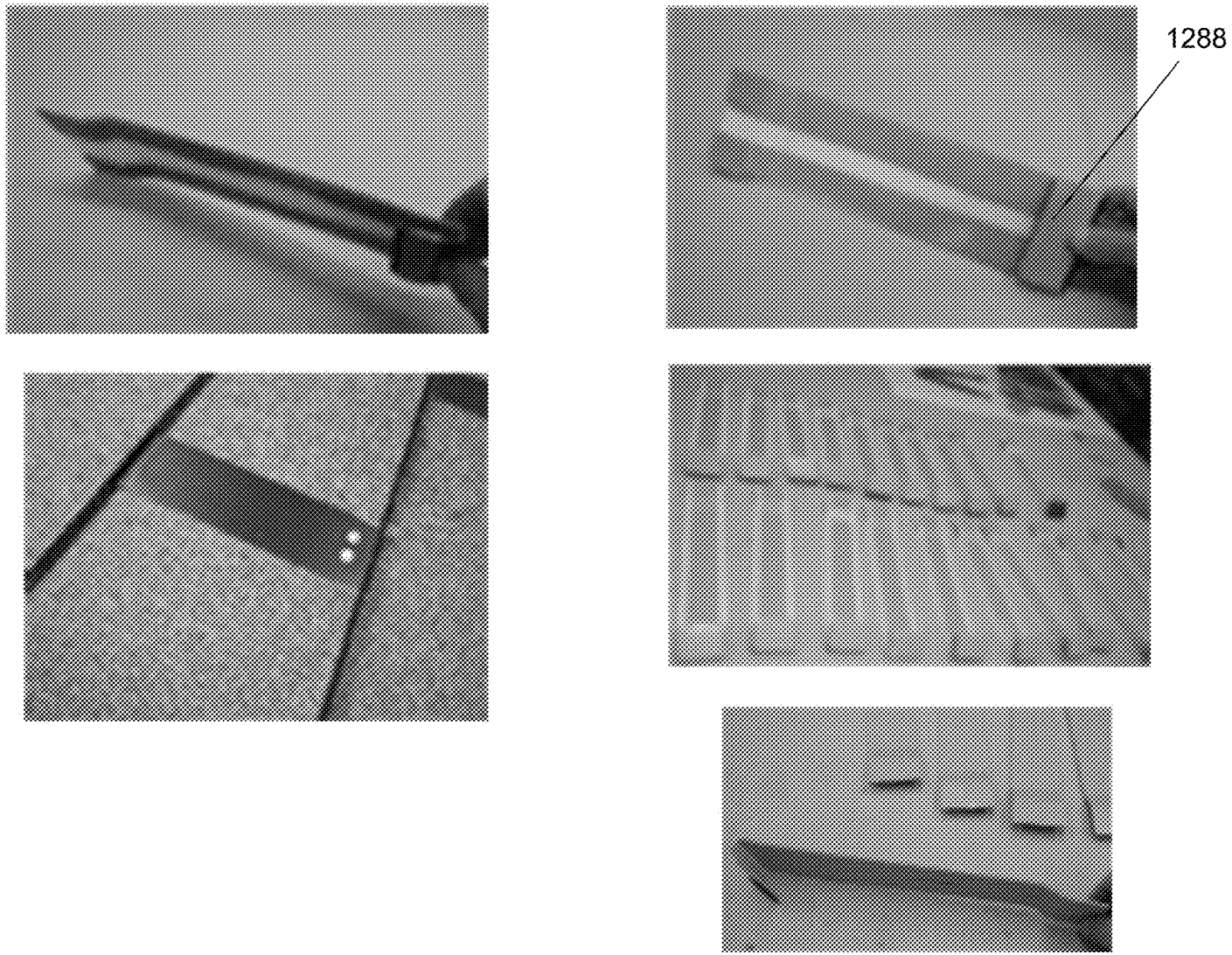

FIG. 43 shows a joint cap with counterflashing 1286. The counterflashing is bent under the plank lap, and one or two strips of the butyl-based gasket are attached to the backside of the cap, which is secured with screws. Two strips can partially cover the back of the cap, or cover the entirety of the cap. Additional sealant can be added to the butt joints prior to installing the cap to further enhance waterproofing.

Figure 44:
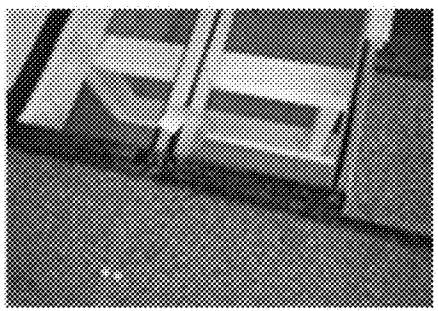
FIG. 44 shows a design for a ridge cap.
Figure 44:
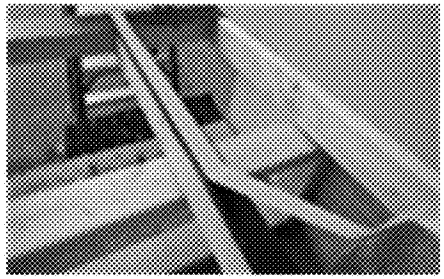
Figure 44:
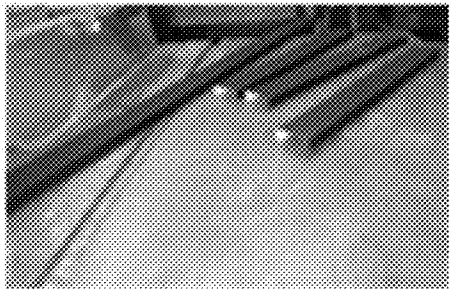
Figure 44:
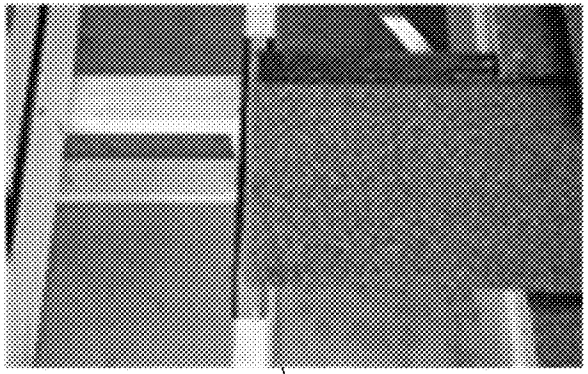

FIG. 44 shows a rafter cap 1290 made of aluminum trim coil, bend in a U-shape to cap the rafters. Butyl gaskets are set underneath the butt joint, and secured with screws.

Figure 45:
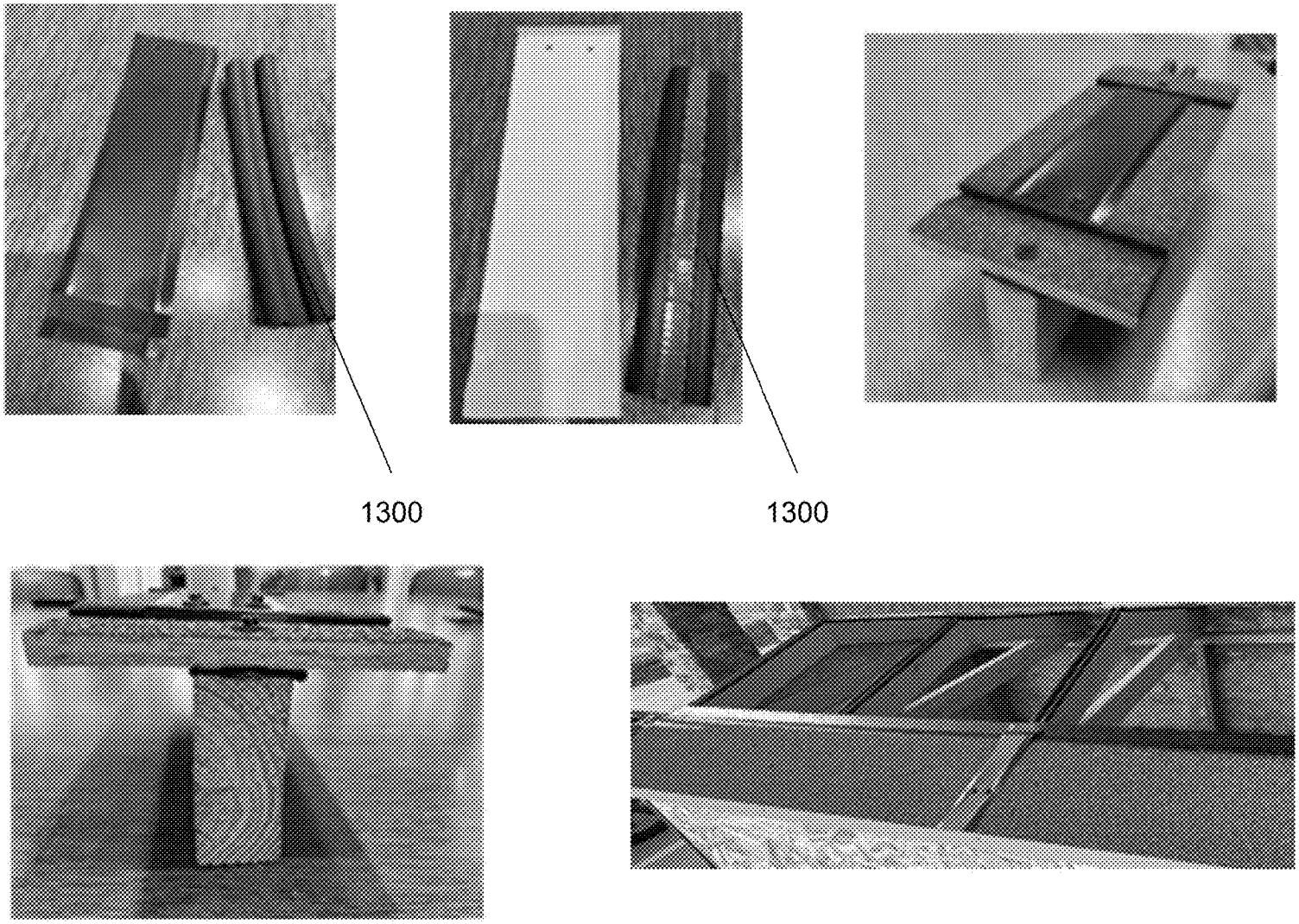
FIG. 45 shows a truss trop cord gasket assembly.

FIG. 45 shows a "double bulb" gasket (EPDM sponge rubber seal) 1300 installed along each truss top cord on the roof assembly first. The planks are then installed using a running bond pattern, and metal caps are placed over the joint and secured with screws to prevent leakage at the plank butt joints and eliminate the use of silicone sealant or caulk to give better aesthetics and functional products.

The present invention possesses several advantages over the prior art. It provides a superior barrier system that does not allow air movement between the panel face and the applied WRB, and allows a savings in time and labor. Further, coating the panels in a controlled setting (e.g., manufacturing facility), allows the thickness of the coatings to be consistently applied, and allows the coating the opportunity to fully bond with the panel or adjacent layer. More specifically, the coatings can fully cure independent of weather conditions, and be applied without interference from construction-related dirt, debris or humidity. Further, the mineral granules or other texture-providing material may be included to increase the aesthetic appeal of the product, as well as to serve as a cooling agent in some cases, thereby enhancing energy efficiency.

Further, the WRB material also may provide an aesthetic effect, in appearance or texture, or both. The aesthetic effect may include color. In several embodiments, a double coating may be applied to provide a textured or aggregate-like appearance.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An integrated roofing system, comprising:

a plurality of a roofing panel or plank, each comprising:

a base layer comprising engineered wood, the base layer comprising an outer face, a top edge, a bottom edge, a left edge, and a right edge; wherein the upper edge comprises an underlap portion of a shiplap joint, and the bottom edge comprises an overlap portion of a shiplap joint;

a water resistant barrier layer covering at least the outer face of the base layer; and a surface layer covering the water resistant barrier layer, the surface layer comprising asphalt with a plurality of granular material disposed thereon or mixed therein, the plurality of granular material providing a visible texture on the upper surface of the roofing panel or plank;

further wherein at least one of said plurality of roofing panel or plank also has at least one of the edges covered by the water resistant barrier layer;

further wherein at least one of said plurality of roofing panel or plank comprises one or more flashing pieces extending outward from one or more edges of the roofing panel or plank; and further wherein at least one of said plurality of roofing panel or plank comprises a sealing gasket affixed proximate the top edge, wherein the sealing gasket comprises a D-gasket with a hollow interior.

2. The system of claim 1, further comprising an appearance layer covering the surface layer, said appearance layer comprising a polymeric layer with texturizing material covering or integrated with the polymeric layer, wherein the texturizing material comprises one or more of: ceramic coated granules, rock, glass, slate, rubber, plastic, or a synthetic polymer.

3. The system product of claim 1, wherein the water resistant barrier layer covers the top edge and the bottom edge of each of said roofing panel or plank.

4. The system of claim 1, at least one of said plurality of roofing panel or plank further comprising one or more water evacuation channels extending orthogonally downward from a lower lip of the underlap portion at least partway down the outer face.

5. The system of claim 1, wherein the underlap portion comprises an underlap joint face parallel to the outer face, and the underlap joint face is covered at least in part by the water resistant barrier layer.

6. The system of claim 1, wherein the water resistant barrier layer comprises a polymer.

7. The system of claim 1, wherein the flashing comprises a polymer.

8. The system of claim 1, wherein the flashing is integrated with the base layer or the water resistant barrier layer.

9. The system of claim 4, wherein the flashing extends from the overlap portion and over said shiplap joint.

10. The system of claim 1, wherein the flashing is the same color as an outward facing surface of the roofing panel or plank.

11. The system of claim 1, wherein the flashing extends straight outward in a plane.

12. The system of claim 1, wherein the flashing is bent or folded one or more times.

13. The system of claim 1, wherein the flashing comprises a flexible polymer configured to be molded during installation to a structure to be flashed.

14. The system of claim 1, further comprising one or more vents extending through at least one of said plurality of roofing panel or plank.

15. The system of claim 14, wherein the one or more vents are located proximate the top edge.

16. The system of claim 1, wherein the flashing is integrated with the respective roofing panel or plank in a processing line at a manufacturing facility, prior to installation on a structure.

17. The system of claim 14, wherein the one or more vents are integrated with the respective roofing panel or plank in a processing line at a manufacturing facility, prior to installation on a structure.

18. The system of claim 1, further comprising:

a plurality of a starter type of roofing panel or plank, each comprising:

a base layer comprising engineered wood, the base layer comprising an outer face, a top edge, a bottom edge, a left edge, and a right edge; wherein the upper edge comprises the underlap portion of the shiplap joint, and the bottom edge comprises an integrated angled drip edge face at an acute angle with relation to the outer face;

a water resistant barrier layer covering at least the outer face of the base layer; and a surface layer covering the water resistant barrier layer, the surface layer comprising asphalt with a plurality of granular material disposed thereon or mixed therein, the plurality of granular material providing a visible texture on the upper surface of the roofing panel or plank;

wherein the plurality of starter type roofing panels or planks are configured to be placed as a bottommost row on a roof below one or more rows of the plurality of roofing panels or planks; and further wherein the acute angle is 25 degrees.

19. The system of claim 18, further comprising:

a plurality of a crown type of roofing panel or plank, each comprising:

a base layer comprising engineered wood, the base layer comprising an outer face, a top edge, a bottom edge, a left edge, and a right edge; wherein the upper edge comprises a butt end profile, and the bottom edge comprises the underlap portion of the shiplap joint;

a water resistant barrier layer covering at least the outer face of the base layer and the upper edge; and a surface layer covering the water resistant barrier layer, the surface layer comprising asphalt with a plurality of granular material disposed thereon or mixed therein, the plurality of granular material providing a visible texture on the upper surface of the roofing panel or plank;

wherein the plurality of crown type roofing panels or planks are configured to be placed as a topmost row on a roof above one or more rows of the plurality of roofing panels or planks; and further wherein each of said plurality of crown type of roofing panel or plank comprises one or more integrated vents proximate the top edge.

20. The system of claim 19, further wherein each of said roofing panel or plank further comprises:

a radiant barrier layer covering an inner face of the base layer; and a silicone layer covering the surface layer, wherein the silicone layer is embossed.

* * * * *